US012747561B2

(12) United States Patent
Kitahara

(10) Patent No.: US 12,747,561 B2
(45) Date of Patent: Sep. 29, 2026

(54) ELECTRIC WORK MACHINE

(71) Applicant: Yanmar Holdings Co., Ltd., Osaka (JP)

(72) Inventor: Satoshi Kitahara, Chikugo (JP)

(73) Assignee: YANMAR HOLDINGS CO., LTD., Osaka (JP)

( * ) Notice: Subject to any disclaimer, the term of this patent is extended or adjusted under 35 U.S.C. 154(b) by 292 days.

(21) Appl. No.: 18/215,045

(22) Filed: Jun. 27, 2023

(65) Prior Publication Data

US 2023/0417022 A1 Dec. 28, 2023

(30) Foreign Application Priority Data

Jun. 28, 2022 (JP) ..... 2022-103637

(51) Int. Cl.
*E02F 9/22* (2006.01)

(52) U.S. Cl.
CPC ..... *E02F 9/226* (2013.01)

(58) Field of Classification Search
CPC ..... E02F 3/32; E02F 9/0866; E02F 9/0808; E02F 3/961; E02F 9/006
See application file for complete search history.

(56) References Cited

U.S. PATENT DOCUMENTS 8,727,055 B2 * 5/2014 Matsumura ..... B62D 21/186 180/68.5
9,757,485 B2 * 9/2017 Papadopoulos ..... C02F 1/008
9,923,214 B2 * 3/2018 Kawakami ..... H01M 10/613
10,487,781 B2 * 11/2019 Ishikawa ..... F02M 26/14
11,002,146 B1 * 5/2021 O'Neill ..... F01D 15/10
2013/0071212 A1 * 3/2013 Yunoue ..... E02F 9/0883 414/685

(Continued)

FOREIGN PATENT DOCUMENTS

EP 3705631 A1 3/2020
JP 2005299182 A * 10/2005

(Continued)

OTHER PUBLICATIONS

European Search Report dated Nov. 22, 2023 issued in EP Application No. 23179380.3.

*Primary Examiner* — Redhwan K Mawari
(74) *Attorney, Agent, or Firm* — NORTON ROSE FULBRIGHT US LLP

(57) ABSTRACT

A hydraulic excavator provided as an electric work machine includes an electric motor, an electric instrument connected to the electric motor via a power supply path, a first heat exchanger that cools a refrigerant passing through the electric instrument, a hydraulic pump driven by the electric motor and discharges a hydraulic oil, a second heat exchanger that cools the hydraulic oil, a fan, and first and second flow paths. The first flow path has a first flow path one-end-side opening at one end thereof. The second flow path has a second flow path one-end-side opening at one end thereof. The first flow path one-end-side opening is located at the flow path of wind generated by driving the fan and crossing the first heat exchanger. The second flow path one-end-side opening is located at the flow path of wind generated by driving the fan and crossing the second heat exchanger.

20 Claims, 28 Drawing Sheets

(56) References Cited

U.S. PATENT DOCUMENTS

| | | | | |
|---|---|---|---|---|
| 2013/0294876 | A1* | 11/2013 | Kobayashi | E02F 9/0883 414/744.2 |
| 2016/0237649 | A1* | 8/2016 | Huissoon | B60K 25/06 |
| 2017/0268200 | A1* | 9/2017 | Todokoro | B60K 11/08 |
| 2018/0299173 | A1* | 10/2018 | Huang | F25B 41/26 |
| 2018/0356124 | A1* | 12/2018 | Gupte | F24F 3/044 |
| 2019/0162454 | A1* | 5/2019 | Hatomura | F25B 47/02 |
| 2020/0158390 | A1* | 5/2020 | Shen | F25B 49/02 |
| 2020/0361306 | A1* | 11/2020 | Okazaki | B60K 13/02 |
| 2021/0142921 | A1* | 5/2021 | Joshi | F02C 1/10 |
| 2021/0148605 | A1* | 5/2021 | Wilson | F24H 3/087 |
| 2021/0285189 | A1* | 9/2021 | Pokorný | E03B 3/28 |
| 2022/0107124 | A1* | 4/2022 | Attari | F25B 41/20 |
| 2022/0145587 | A1* | 5/2022 | Takeo | E02F 9/2217 |

FOREIGN PATENT DOCUMENTS

| | | | | | |
|---|---|---|---|---|---|
| JP | 2020089049 | A | * | 6/2020 | |
| JP | 2021-080708 | A | | 5/2021 | |
| KR | 101751086 | B1 | * | 6/2017 | B60K 11/08 |
| WO | WO-2019183682 | A1 | * | 10/2019 | A47J 27/10 |

* cited by examiner

ELECTRIC WORK MACHINE

CROSS-REFERENCE TO RELATED APPLICATIONS

This application claims priority under 35 U.S.C. § 119 to JP Application No. 2022-103637 filed Jun. 28, 2022 the entire contents of which are hereby incorporated by reference.

TECHNICAL FIELD

The present invention relates to an electric work machine.

BACKGROUND ART

Various types of electric work machines such as electric hydraulic excavators equipped with electric motors have been proposed. For example, Patent Document 1 discloses an electric hydraulic excavator including fans, one for cooling a radiator, an electric motor, an inverter, and the like, and the other for cooling an oil cooler.

PRIOR ART DOCUMENT

Patent Document

Patent Document 1: Japanese Unexamined Patent Application Publication No. 2021-080708

SUMMARY OF INVENTION

Technical Problem

Electric work machines of small backward turn type, such as mini excavators, have a limited layout space for components in the engine room. Therefore, it is generally difficult to apply the structure of Patent Document 1, that is, the structure including individual cooling fans for a radiator (first heat exchanger) and an oil cooler (second heat exchanger) to small electric work machines.

In addition, heat-generating components, such as an electric motor and electric components (for example, an inverter), are disposed in the engine room. From the viewpoint of improving the cooling efficiency of heat-generating components, it is desirable to implement a layout enabling effective use of wind used for cooling the first or second heat exchanger to cool (air-cool) the heat-generating components.

The present invention has been made to solve the above problem, and an object thereof is to provide an electric work machine that can cool first and second heat exchangers in a compact layout and can effectively use the wind used for cooling the first or second heat exchanger.

Solution to Problem

An electric work machine according to an aspect of the present invention includes an electric motor, an electric instrument connected to the electric motor via a power supply path, a first heat exchanger that cools a refrigerant passing through the electric instrument, a hydraulic pump driven by the electric motor and discharging a working oil, a second heat exchanger that cools the working oil, a fan, and a first flow path and a second flow path, in which the first flow path has a first flow path one-end-side opening at one end thereof, the second flow path has a second flow path one-end-side opening at one end thereof, the first flow path one-end-side opening is located at a flow path of wind generated by driving the fan and crossing the first heat exchanger, and the second flow path one-end-side opening is located at a flow path of wind generated by driving the fan and crossing the second heat exchanger.

Advantageous Effects of Invention

With the above structure, the first and second heat exchangers can be cooled in a compact layout, and the wind used for cooling either the first or second heat exchanger can be effectively used.

DESCRIPTION OF EMBODIMENTS

An embodiment of the present invention will be described below with reference to the accompanying drawings.

1. ELECTRIC WORK MACHINE

Figure 1:
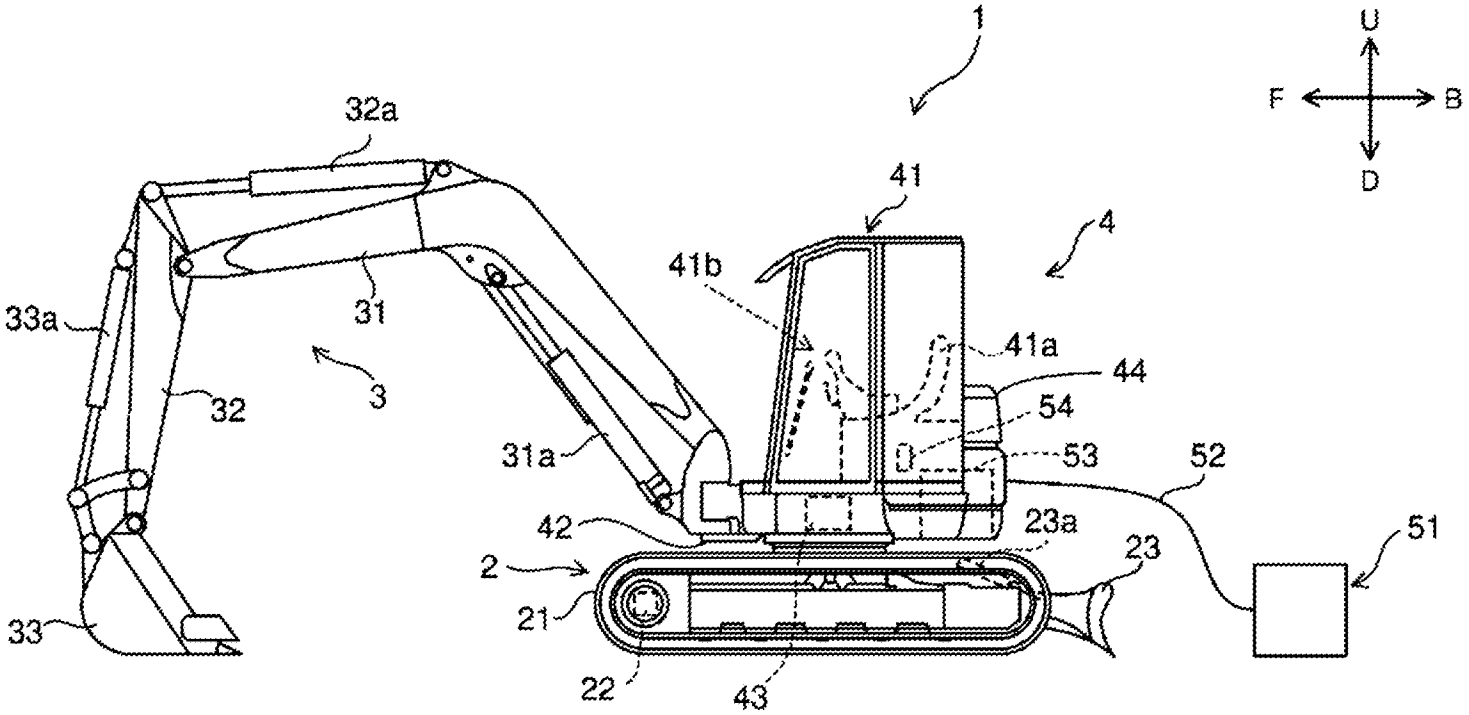
FIG. 1 is a side view schematically illustrating a structure of a hydraulic excavator provided as an example of an electric work machine according to an embodiment of the present invention.

FIG. 1 is a side view schematically illustrating the structure of a hydraulic excavator (electric excavator) 1 provided as an example of the electric work machine according to the present embodiment. The hydraulic excavator 1 includes a lower traveling body 2, a work instrument 3, and an upper turning body 4.

Here, directions are defined as follows. A forward direction is a direction in which an operator (manipulator, driver) sitting on a driver seat 41*a* of the upper turning body 4 faces front, and a backward direction is a direction opposite to the forward direction. When the upper turning body 4 is in a no-turn state (zero degree turning angle) relative to the lower traveling body 2, a front-back direction of the upper turning body 4 matches a direction in which the lower traveling body 2 moves forward and backward. The left side of the operator seated on the driver seat 41*a* is defined as "left", and the right side thereof is defined as "right". A gravity direction perpendicular to the front-back direction and the left-right direction is defined as an up-down direction, in which an upstream side of the gravity direction is defined as "up", and a downstream side thereof is defined as "down". In the drawings, the hydraulic excavator 1 is illustrated when the upper turning body 4 in a no-turn state relative to the lower traveling body 2. Also, in the drawings, the symbols "F", "B", "R", "L", "U", and "D" respectively represent forward, backward, rightward, leftward, upward, and downward.

The lower traveling body 2 includes a pair of left and right crawlers 21 and a pair of left and right traveling motors 22. Each traveling motor 22 is a hydraulic motor. The left and right traveling motors 22 drive corresponding left and right crawlers 21 to move the hydraulic excavator 1 forward and backward. The lower traveling body 2 includes a blade 23 and a blade cylinder 23*a* for performing ground leveling. The blade cylinder 23*a* is a hydraulic cylinder that rotates the blade 23 in the up-down direction.

The work instrument 3 includes a boom 31, an arm 32, and a bucket 33. The boom 31, the arm 32, and the bucket 33 can be independently driven to perform excavation of earth and sand, and the like.

The boom 31 is rotated by a boom cylinder 31*a*. The boom cylinder 31*a* has a base end portion thereof supported on a front portion of the upper turning body 4 and movable freely in an extendable and retractable manner. The arm 32 is rotated by an arm cylinder 32*a*. The arm cylinder 32*a* has a base end portion thereof supported on a tip end portion of the boom 31, and is movable freely in an extendable and retractable manner. The bucket 33 is rotated by a bucket cylinder 33*a*. The bucket cylinder 33*a* has a base end portion thereof supported on a tip end portion of the arm 32, and is freely movable in an extendable and retractable manner. The boom cylinder 31*a*, the arm cylinder 32*a*, and the bucket cylinder 33*a* are each composed of a hydraulic cylinder.

The upper turning body 4 is located above the lower traveling body 2 and can turn relative to the lower traveling body 2 via a turning bearing (not illustrated). The upper turning body 4 includes an operation unit 41, a turn frame 42 (machine body frame), a turn motor 43, an engine room 44, and the like. The upper turning body 4 is turned via the turning bearing upon activation of the turn motor 43 provided as a hydraulic motor.

Figure 2:
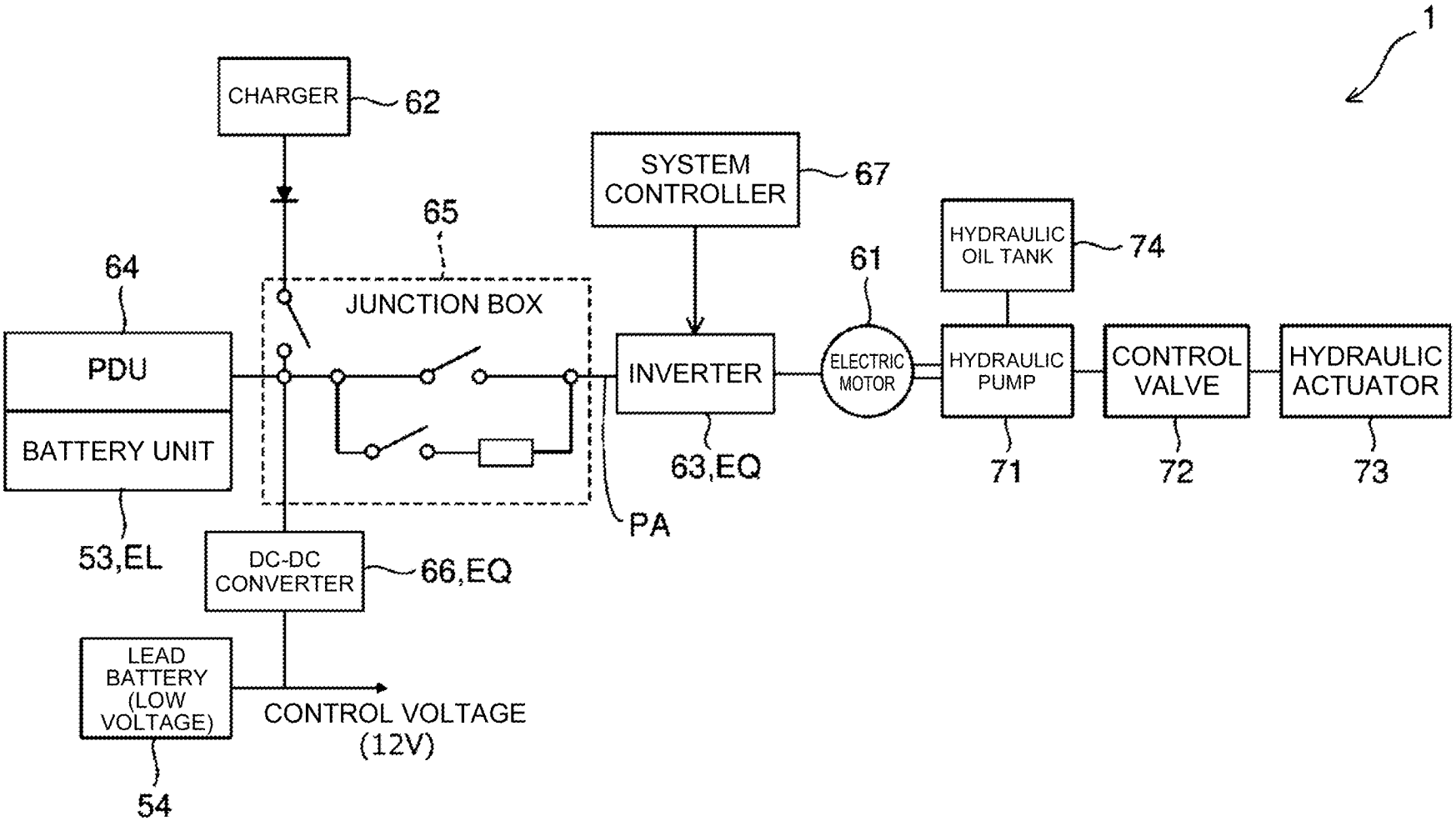
FIG. 2 is a block diagram schematically illustrating the structure of electric and hydraulic systems of the hydraulic excavator.

The upper turning body 4 includes a hydraulic pump 71 (FIG. 2). The hydraulic pump 71 is driven by an electric motor 61 (see FIG. 2) inside the engine room 44. The hydraulic pump 71 supplies a hydraulic oil (pressure oil) to hydraulic motors (for example, the left and right traveling motors 22 and the turn motor 43), and hydraulic cylinders (for example, the blade cylinder 23*a*, the boom cylinder 31*a*, the arm cylinder 32*a*, and the bucket cylinder 33*a*). The hydraulic motors and the hydraulic cylinders that are driven with the hydraulic oil supplied from the hydraulic pump 71 are collectively referred to as hydraulic actuators 73 (see FIG. 2).

The driver seat 41*a* is placed in the operation unit 41. Various levers 41*b* are disposed around the driver seat 41*a*. The operator is seated on the driver seat 41*a* and operates the lever 41*b* to drive the hydraulic actuators 73. This allows the lower traveling body 2 to travel, performs ground levelling by the blade 23, performs excavation by the work instrument 3, turns the upper turning body 4, and the like.

A battery unit 53 is disposed at the upper turning body 4. The battery unit 53 is composed of, for example, a lithium-ion battery unit, and stores electric power for driving the electric motor 61. The battery unit 53 may be composed of a plurality of batteries as a unit or may be composed of a single battery cell. The upper turning body 4 has a power feed port which is not illustrated. The power feed port and a commercial power source 51, which is an external power source, are connected via a power feed cable 52. This allows charging of the battery unit 53.

The upper turning body 4 also includes a lead battery 54. The lead battery 54 outputs a low voltage (12 V, for example) DC voltage. The output from the lead battery 54 is supplied as a control voltage to, for example, a system controller 67 (see FIG. 2), a drive unit of a fan 91 (see FIG. 5), and the like.

The hydraulic excavator 1 may be configured with hydraulic equipment such as the hydraulic actuators 73 and other actuators driven by electric power. The electrically-driven actuators include, for example, an electric traveling motor, an electric cylinder, and an electric turn motor.

2. STRUCTURE OF ELECTRIC SYSTEM AND HYDRAULIC SYSTEM

FIG. 2 is a block diagram schematically illustrating the structure of electric and hydraulic systems of the hydraulic excavator 1. The hydraulic excavator 1 includes the electric motor 61, a charger 62, an inverter 63, a power drive unit (PDU) 64, a junction box 65, a DC-DC converter 66, and the system controller 67. The system controller 67 is composed of an electronic control unit (ECU) for electrically controlling individual parts of the hydraulic excavator 1.

The electric motor 61 is driven by electric power supplied from the battery unit 53 via the junction box 65 and the inverter 63. The electric motor 61 is composed of a permanent magnet motor or an induction motor. The electric motor 61 is disposed on the turn frame 42.

The battery unit 53 described above is a type of electric instrument EL connected to the electric motor 61 via a power supply path PA. In other words, the hydraulic excavator 1 includes the electric instrument EL which includes the battery unit 53 mentioned above.

The charger 62 (also referred to as a power feeder) converts AC voltage supplied from the commercial power source 51 illustrated in FIG. 1 via the power feed cable 52. The inverter 63 converts the DC voltage supplied from the battery unit 53 into an AC voltage and supplies it to the electric motor 61. This rotates the electric motor 61. The AC voltage (current) from the inverter 63 to the electric motor 61 is supplied in response to a rotation instruction output from the system controller 67.

The PDU 64 is a battery control unit that controls input/output of the battery unit 53 by controlling a battery relay inside. The junction box 65 is composed of a charger relay, an inverter relay, a fuse, and the like. The voltage output from the charger 62 is supplied via the junction box 65 and the PDU 64 to the battery unit 53. The voltage output from the battery unit 53 is supplied to the inverter 63 via the PDU 64 and the junction box 65.

The DC-DC converter 66 lowers a high-voltage (300 V, for example) DC voltage supplied from the battery unit 53 via the junction box 65 to a low voltage (12 V, for example). Similar to the output from the lead battery 54, the voltage output from the DC-DC converter 66 is supplied to the system controller 67, the drive unit of the fan 91, and the like.

A plurality of the hydraulic pumps 71 is connected to a rotation shaft (output shaft) of the electric motor 61. The plurality of hydraulic pumps 71 includes a variable displacement pump and a fixed displacement pump. FIG. 2 illustrates only one hydraulic pump 71 as an example. Each hydraulic pump 71 is connected to a hydraulic oil tank 74 that tanks (stores) the hydraulic oil. Upon activation of the hydraulic pump 71 by the electric motor 61, the hydraulic oil in the hydraulic oil tank 74 is supplied via the control valve 72 to the hydraulic actuator 73. Thus, the hydraulic actuator 73 is driven. The control valve 72 is a direction switch valve that controls the flow direction and flowrate of the hydraulic oil supplied to the hydraulic actuator 73. Thus, the hydraulic excavator 1 includes the hydraulic pump 71 driven by the electric motor 61 to discharge the hydraulic oil.

3. STRUCTURE OF INSIDE OF ENGINE ROOM

Figure 3:
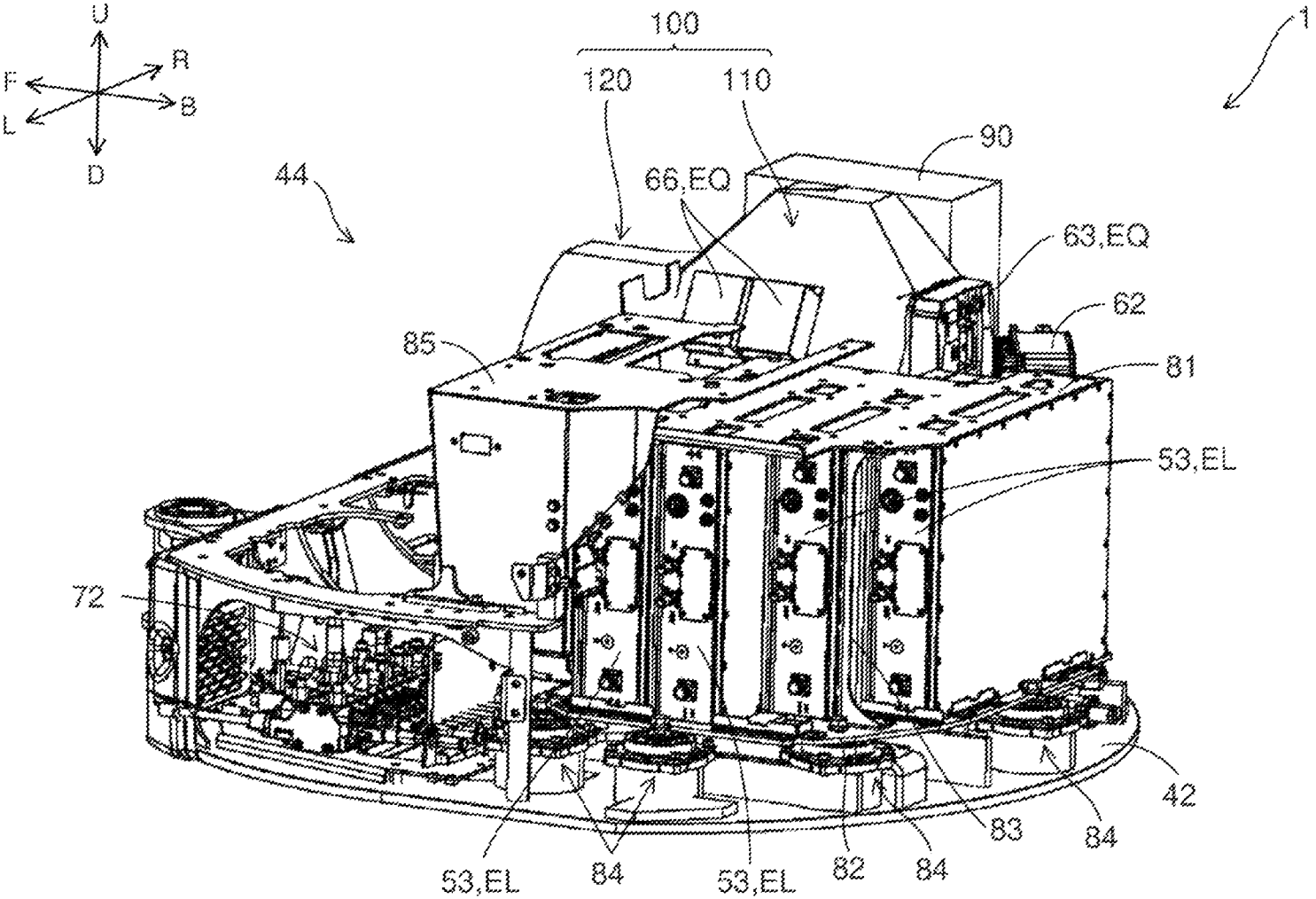
FIG. 3 is a perspective view illustrating an overall structure of the inside of an engine room of the hydraulic excavator.
Figure 4:
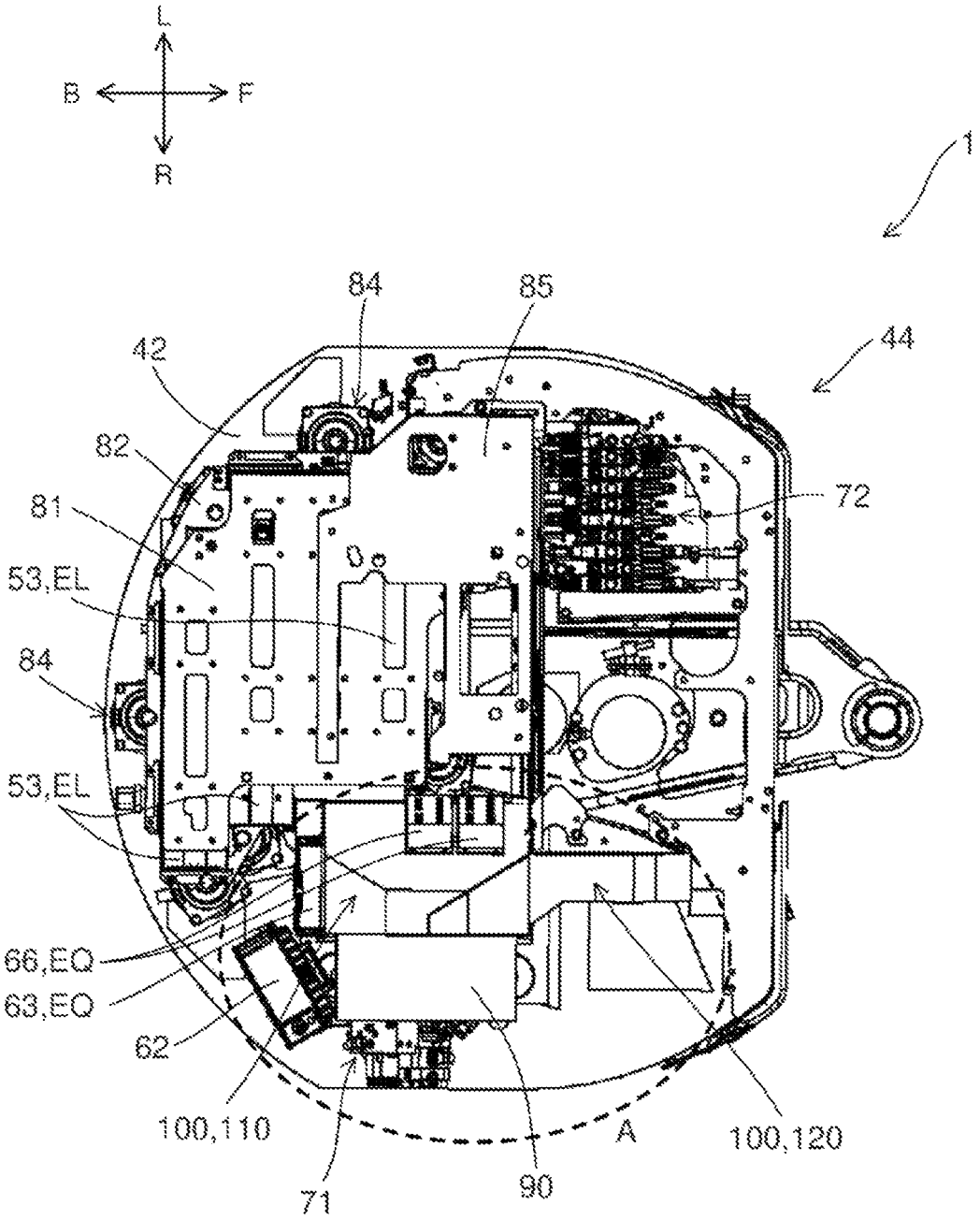
FIG. 4 is a plan view illustrating an overall structure of the inside of the engine room.

FIG. 3 is a back perspective view illustrating the overall structure of the inside of the engine room 44 of the hydraulic excavator 1. FIG. 4 is a plan view illustrating the overall structure of the inside of the engine room 44. As illustrated in FIG. 3, in the present embodiment, four battery units 53 are disposed in a row on the turn frame 42 in the front-back direction. The battery units 53 are each disposed in the left-right direction. The four battery units 53 are disposed on the back side of the turn frame 42 displaced leftward from the center.

In the present embodiment, the two battery units 53 in the back are disposed to the right relative to the front two battery units 53, that is, toward the center side of the turn frame 42. Furthermore, the backmost battery unit 53 of the two back battery units 53 is located further displaced to the right than the battery unit 53 located in front thereof. This allows the plurality of battery units 53 to be arranged efficiently in the limited narrow space near the back edge of the turn frame 42 formed in a semicircular shape in plan view (see FIG. 4). The number and arrangement of the battery units 53 are not limited to the example of the present embodiment.

The plurality of battery units 53 is integrally supported on the turn frame 42. More specifically, the plurality of battery units 53 is sandwiched between an upper plate 81 and a lower plate 82 in the up-down direction. The upper plate 81 and the lower plate 82 are connected at several points with connection members 83 extending in the up-down direction. For example, the upper plate 81 and the connection member 83 and the lower plate 82 and the connection member 83 are connected by bolting. The lower plate 82 is supported by a support 84 on the turn frame 42 in a vibration-proof manner. The placing positions of the support 84 are not limited to the positions illustrated in FIGS. 3 and 4, and can be changed as needed.

A seat mount 85 serving as a base of the driver seat 41*a* is provided between the upper plate 81 and the driver seat 41*a* (see FIG. 1). In FIGS. 3 and 4, only part of the seat mount 85 is illustrated for convenience.

On the turn frame 42, to the right of the plurality of battery units 53 of the electric motor 61 (see FIG. 2), the hydraulic pump 71, and other units described above are disposed. Details thereof are described below.

Figure 5:
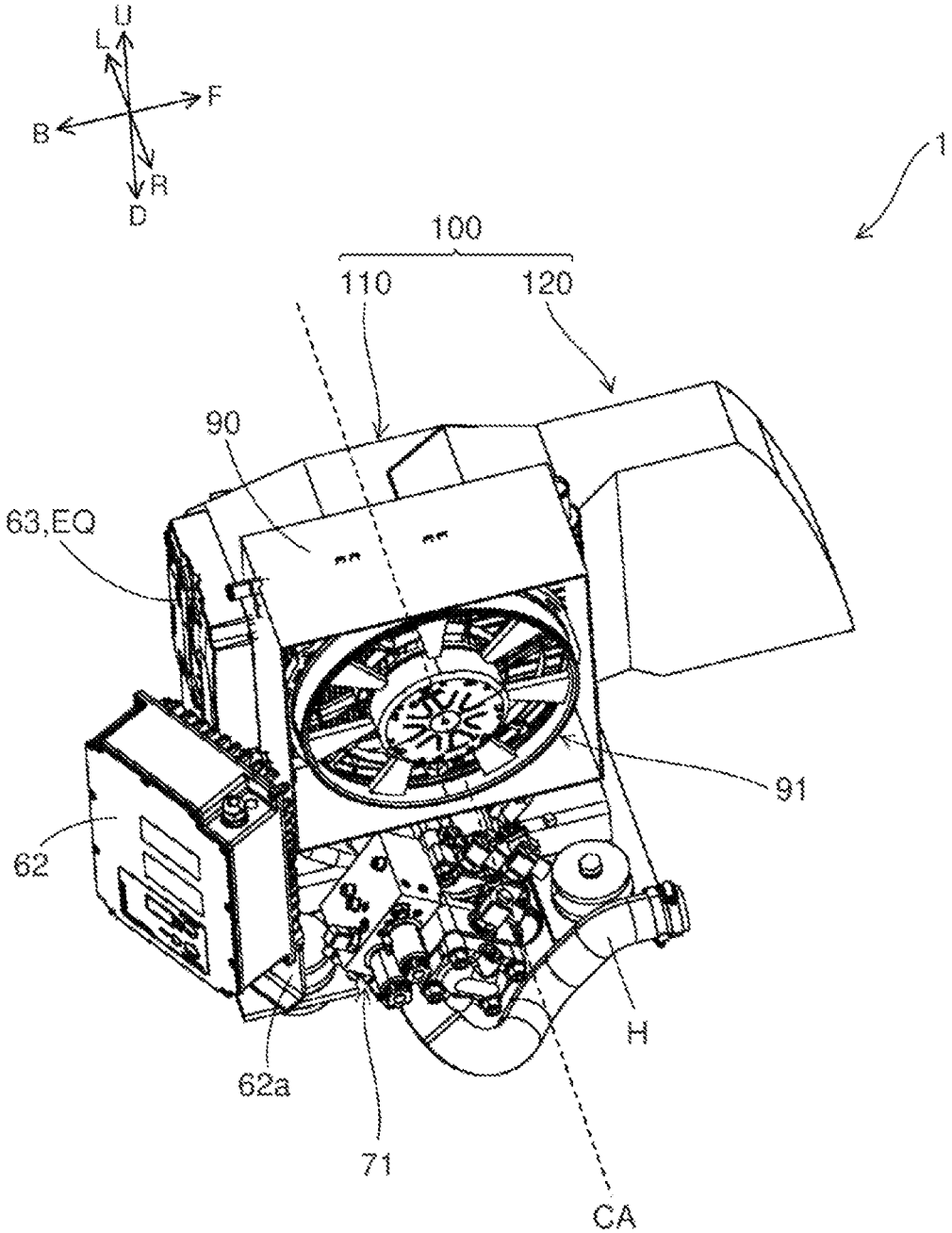
FIG. 5 is a perspective view of a portion A in FIG. 4.

FIG. 5 is a perspective view of a portion A in FIG. 4. The portion A in FIG. 4 here indicates a portion located on the right side of the forwardmost battery unit 53 disposed in the engine room 44. As illustrated in this drawing, the hydraulic excavator 1 includes the fan 91. The fan 91 is rotatably supported by a casing 90. The casing 90 is frame-shaped and opens on the left and right sides. A rotation shaft CA of the fan 91 is located along the left-right direction. The hydraulic pump 71 is located below the fan 91 (casing 90). The hydraulic pump 71 is connected with the hydraulic oil tank 74 (see FIG. 2) via a hydraulic hose H.

On the left side of the casing 90, that is, between the casing 90 and the battery unit 53, a wind guide 100 is disposed. The wind guide 100 will be described in detail later. As illustrated in FIGS. 3 and 5, the electric components EQ, such as the inverter 63 and the DC-DC converter 66 described above, are attached to the wind guide 100 (especially to a first flow path 110 described later).

In FIG. 5, the charger 62 described in the above is disposed behind the fan 91 (casing 90) and the hydraulic pump 71. The charger 62 is supported on the turn frame 42 via a mount stay 62*a* and the like.

Figure 6:
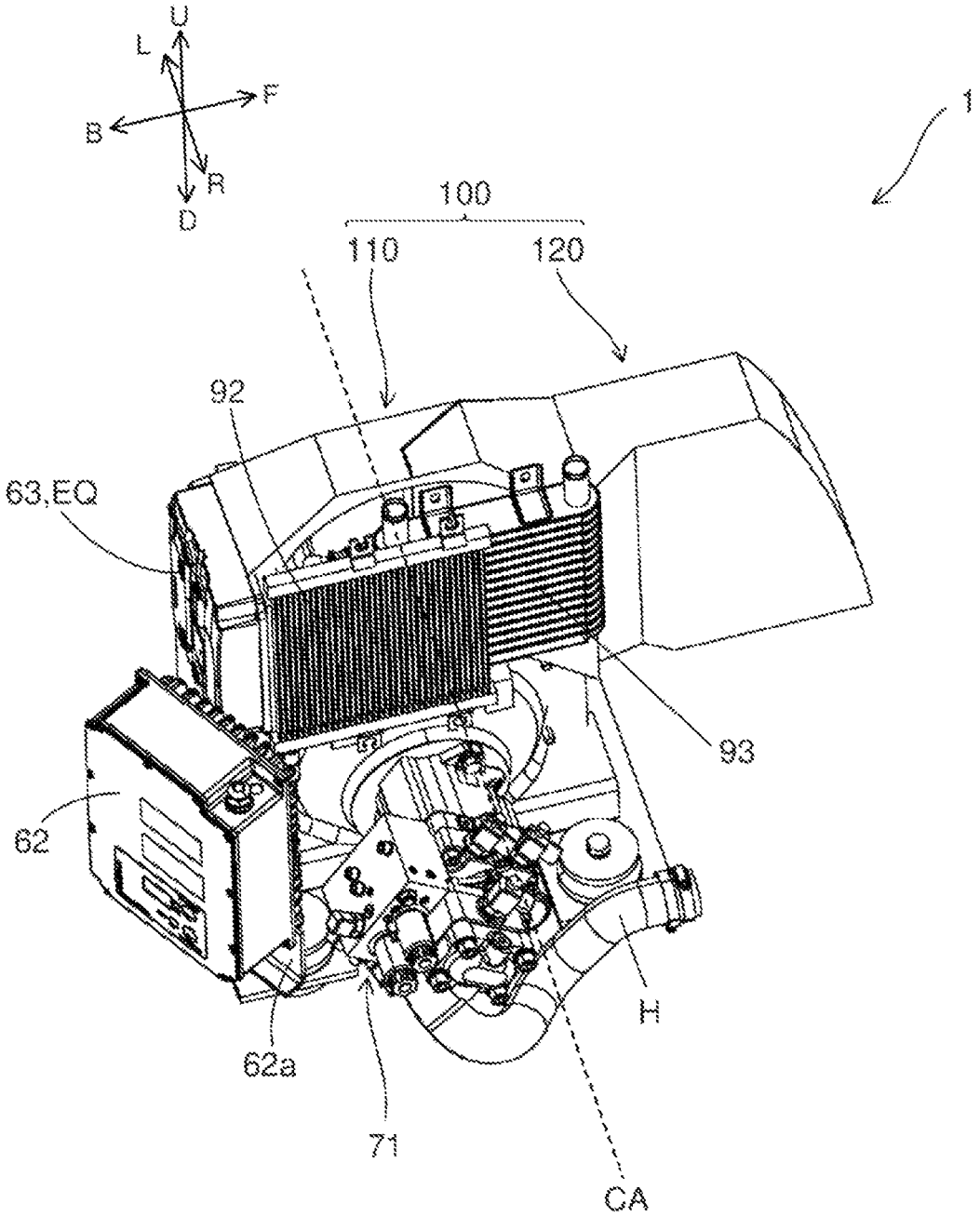
FIG. 6 is a perspective view of the portion A with a fan and a casing omitted from FIG. 5.

FIG. 6 is a perspective view of the portion A with the fan 91 and the casing 90 omitted from FIG. 5. The hydraulic excavator 1 further includes a radiator 92 and an oil cooler 93. The radiator 92 is a first heat exchanger connected via piping to the electric instrument EL (battery unit 53) illustrated, for example, in FIG. 3, to cool the refrigerant flowing through the electric instrument EL. Cooling the refrigerant by heat exchange at the radiator 92 and supplying the refrigerant from the radiator 92 to the battery unit 53 can cool (water-cool) the battery unit 53. For example, the refrigerant is cooling water.

The oil cooler 93 is a second heat exchanger connected to an oil path circulating via the hydraulic pump 71, the hydraulic actuators 73 (see FIG. 2), and the like. The oil cooler 93 uses the heat exchange to cool the hydraulic oil flowing in the oil path by driving the hydraulic pump 71. The oil cooler 93 is displaced to the left and to the front relative to the radiator 92. Alternatively, the oil cooler 93 may be located at the same position as the radiator 92 in the left-right direction. That is, the oil cooler 93 may be disposed alongside the radiator 92 in the front-back direction.

The radiator 92 and the oil cooler 93 are supported inside the casing 90 in FIG. 5 via the stay or the like. The radiator 92 and the oil cooler 93 are located between the fan 91 and the wind guide 100. Thus, the fan 91 is located on the side opposite to the wind guide 100 with respect to the radiator 92 and the oil cooler 93.

Figure 7:
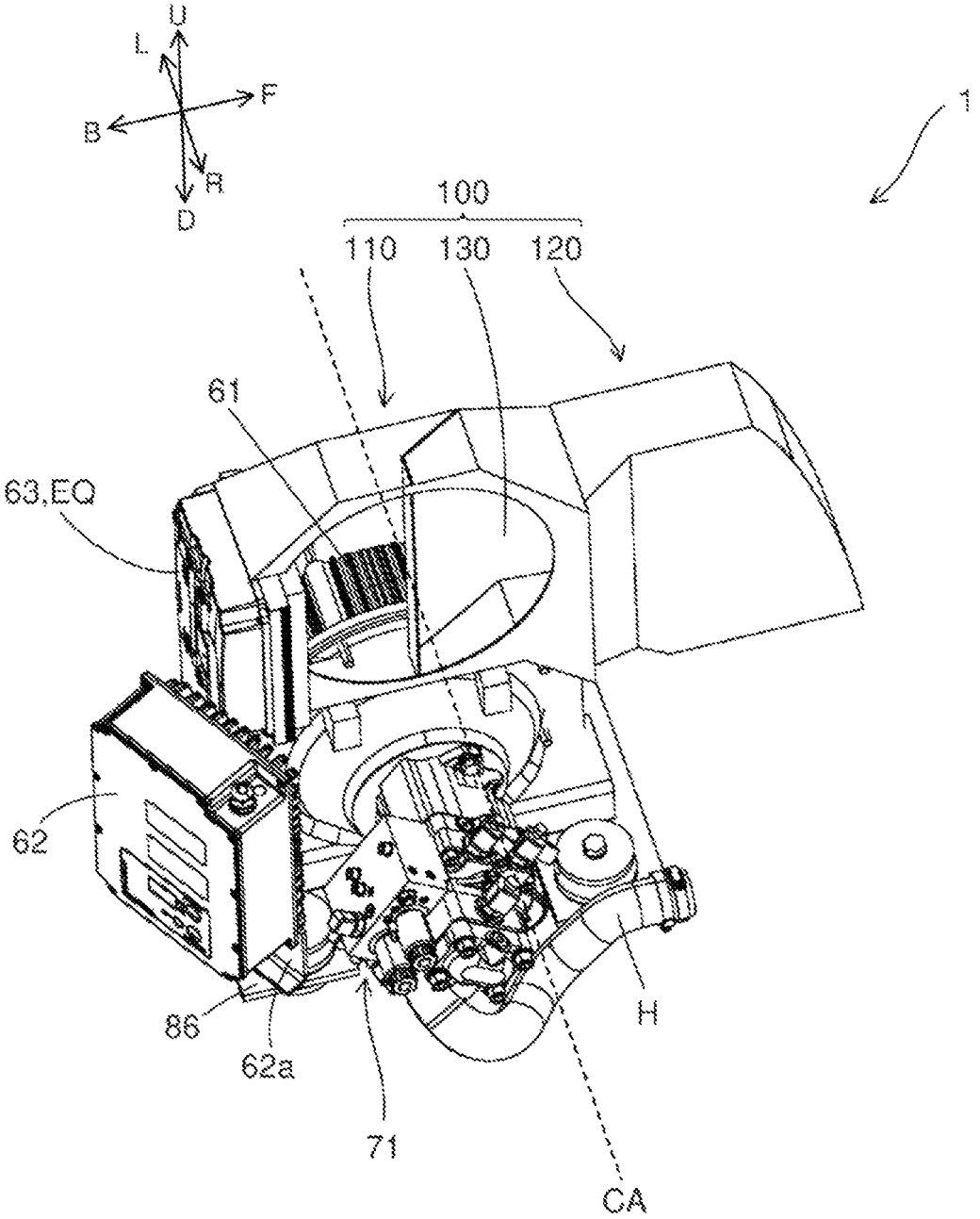
FIG. 7 is a perspective view of the portion A with a radiator and an oil cooler omitted from FIG. 6.

FIG. 7 is a perspective view illustrating the portion A with the radiator 92 and the oil cooler 93 omitted from FIG. 6. The hydraulic excavator 1 includes the wind guide 100. The wind guide 100 includes the first flow path 110 and a second flow path 120. Wind generated by driving the fan 91 passes through the first flow path 110 and the second flow path 120. The wind guide 100 is described in detail below.

Figure 8:
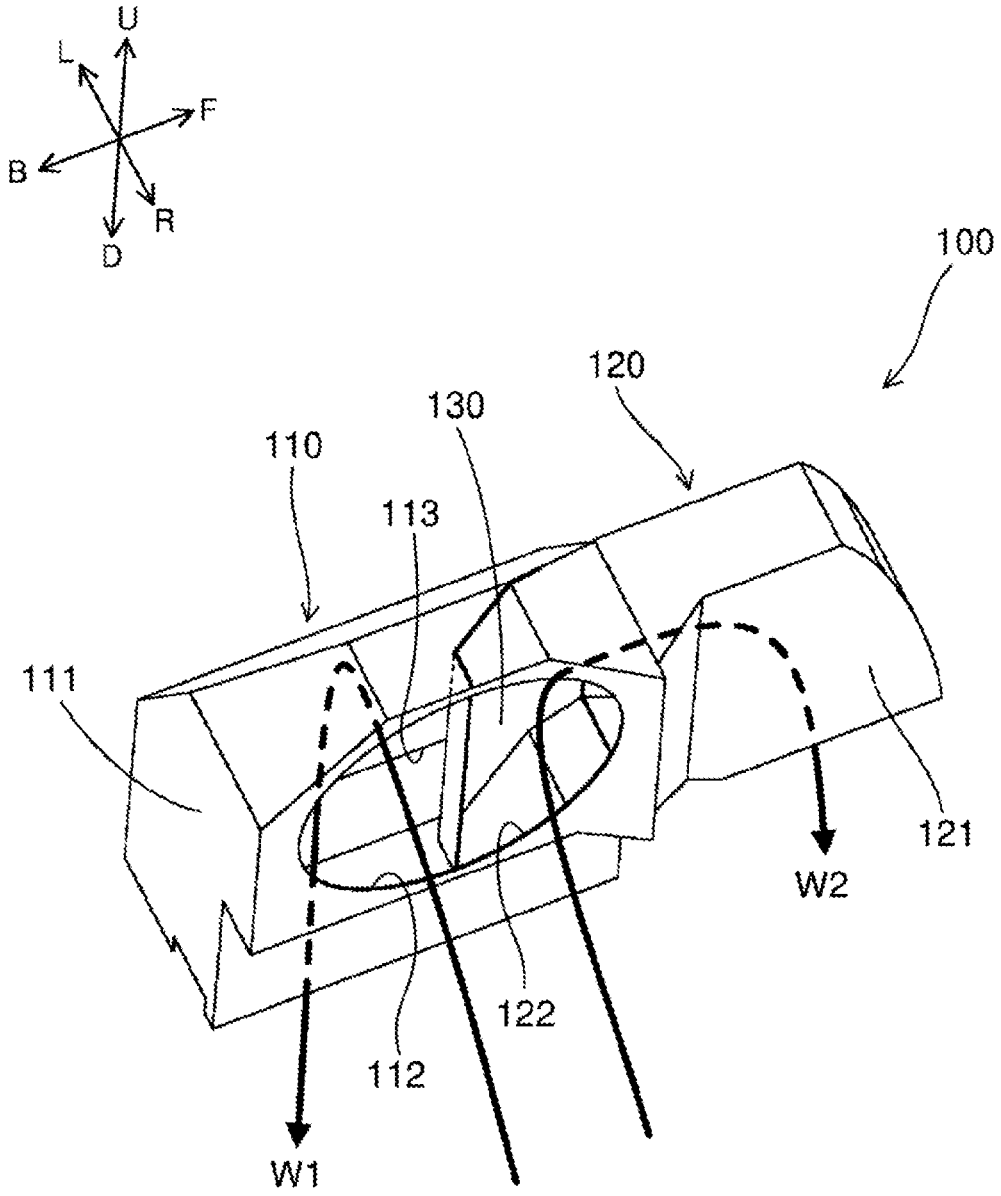
FIG. 8 is a perspective view of a wind guide of the hydraulic excavator when seen from above.
Figure 9:
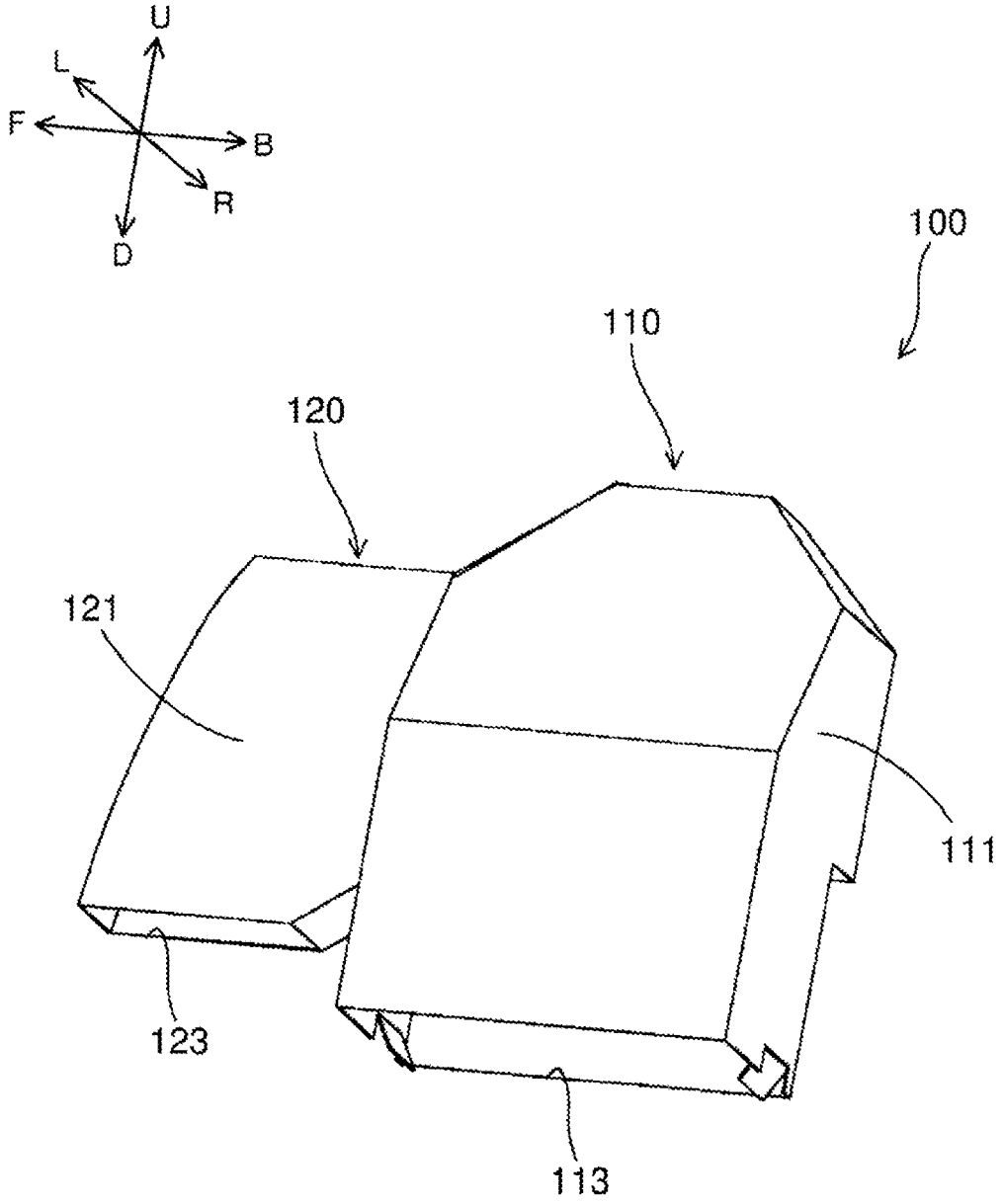
FIG. 9 is a perspective view of the wind guide when seen from below.
Figure 10:
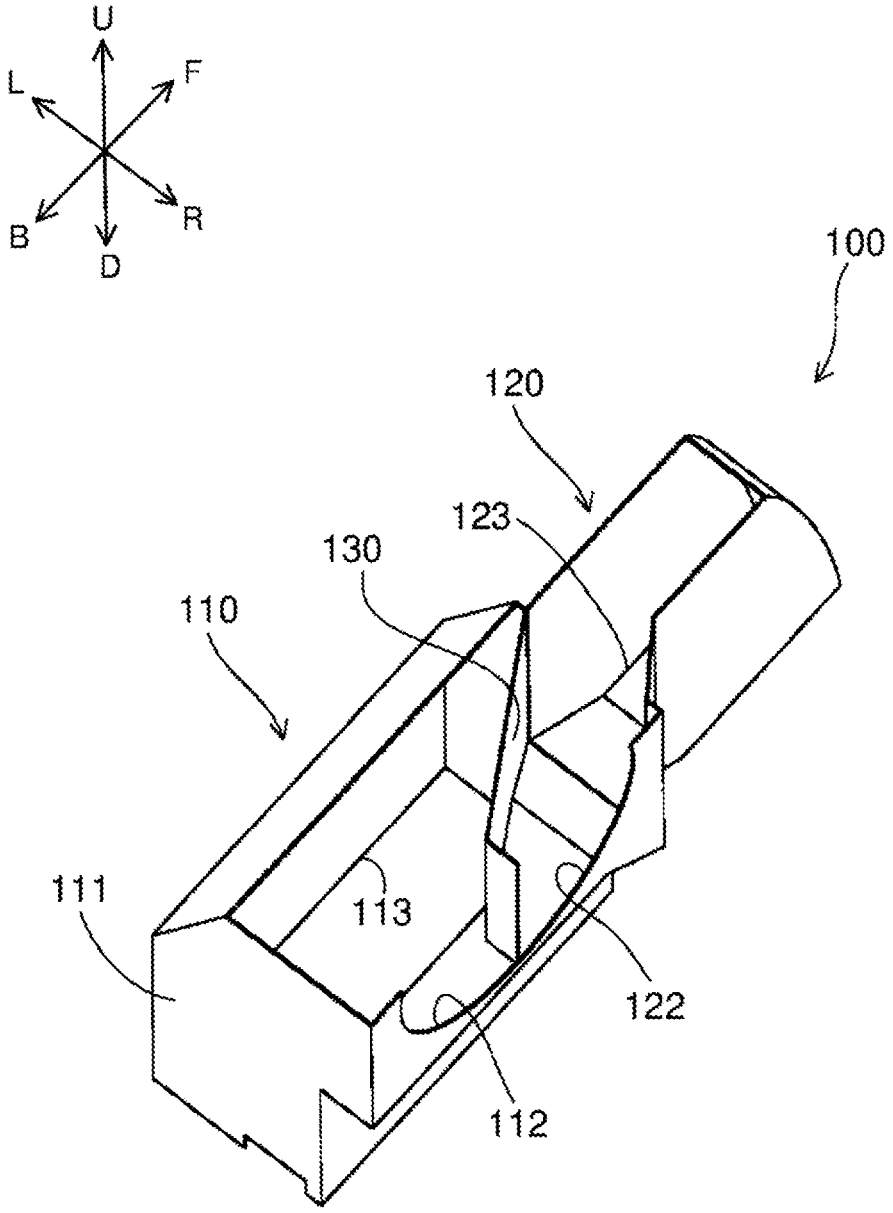
FIG. 10 is a perspective view of the wind guide when cut along a horizontal section.

FIG. 8 is a perspective view of the wind guide 100 when seen from above. FIG. 9 is a perspective view of the wind guide 100 when seen from below. FIG. 10 is a perspective view of the wind guide 100 illustrated in FIG. 8 when cut along a horizontal section.

The first flow path 110 of the wind guide 100 has a first flow path body 111, a first flow path one-end-side opening 112, and a first flow path other-end-side opening 113. The interior of the first flow path body 111 is hollow. Part of the wind generated by driving the fan 91 passes through the interior of the first flow path body 111. The shape of the first flow path body 111 is not limited, but needs to have a cavity through which wind passes.

The first flow path one-end-side opening 112 is an opening formed in the first flow path body 111 at one end of the flow path direction in which the wind flows. In the present embodiment, the first flow path one-end-side opening 112 is formed in a semicircular shape, but its shape is not limited. The first flow path one-end-side opening 112 opens toward the radiator 92 (see FIG. 6) located on the right side of the first flow path body 111. That is, the first flow path one-end-side opening 112 is located facing the radiator 92.

The first flow path other-end-side opening 113 is an opening formed in the first flow path body 111 at the other end of the flow path direction in which the wind flows. In the present embodiment, the shape of the first flow path other-end-side opening 113 is formed in a rectangular shape as illustrated in FIG. 9, but its shape is not limited. The first flow path other-end-side opening 113 opens downward.

The second flow path 120 of the wind guide 100 has a second flow path body 121, a second flow path one-end-side opening 122, and a second flow path other-end-side opening 123. The interior of the second flow path body 121 is hollow. Part of the wind generated by driving the fan 91 passes through the interior of the second flow path body 121. The second flow path body 121 is not limited in shape, but needs to have a cavity through which wind passes.

The second flow path one-end-side opening 122 is an opening formed in the second flow path body 121 at one end of the flow path direction in which the wind flows. In the present embodiment, the shape of the second flow path one-end-side opening 122 is formed in a semicircular shape, but its shape is not limited. The second flow path one-end-side opening 122 opens toward the oil cooler 93 (see FIG. 6) disposed on the right side of the second flow path body 121. That is, the second flow path one-end-side opening 122 is located facing the oil cooler 93.

In the present embodiment, the second flow path one-end-side opening 122 is continuously connected to the first flow path one-end-side opening 112 to form a circular shape (see FIG. 8). Alternatively, the second flow path one-end-side opening 122 and the first flow path one-end-side opening 112 may each be formed in a closed shape and may be spaced apart from each other.

The second flow path other-end-side opening 123 is an opening formed in the second flow path body 121 at the other end of the flow direction through which the wind flows. In the present embodiment, the shape of the second flow path other-end-side opening 123 is formed in a substantially rectangular shape as illustrated in FIG. 9, but its shape is not limited. The second flow path other-end-side opening 123 opens downward.

The wind guide 100 further includes a divider 130. The divider 130 is a bulkhead that partitions the first flow path body 111 of the first flow path 110 from the second flow path body 121 of the second flow path 120. In other words, the first flow path body 111 and the second flow path body 121 share the divider 130 as the bulkhead. The divider 130 extends from the right side toward the left side, then bends and extends diagonally forward to the left, as illustrated in FIG. 10. Such a divider 130 avoids mixing the wind passing through the interior of the first flow path body 111 and the wind passing through the interior of the second flow path body 121 inside the wind guide 100.

Figure 11:
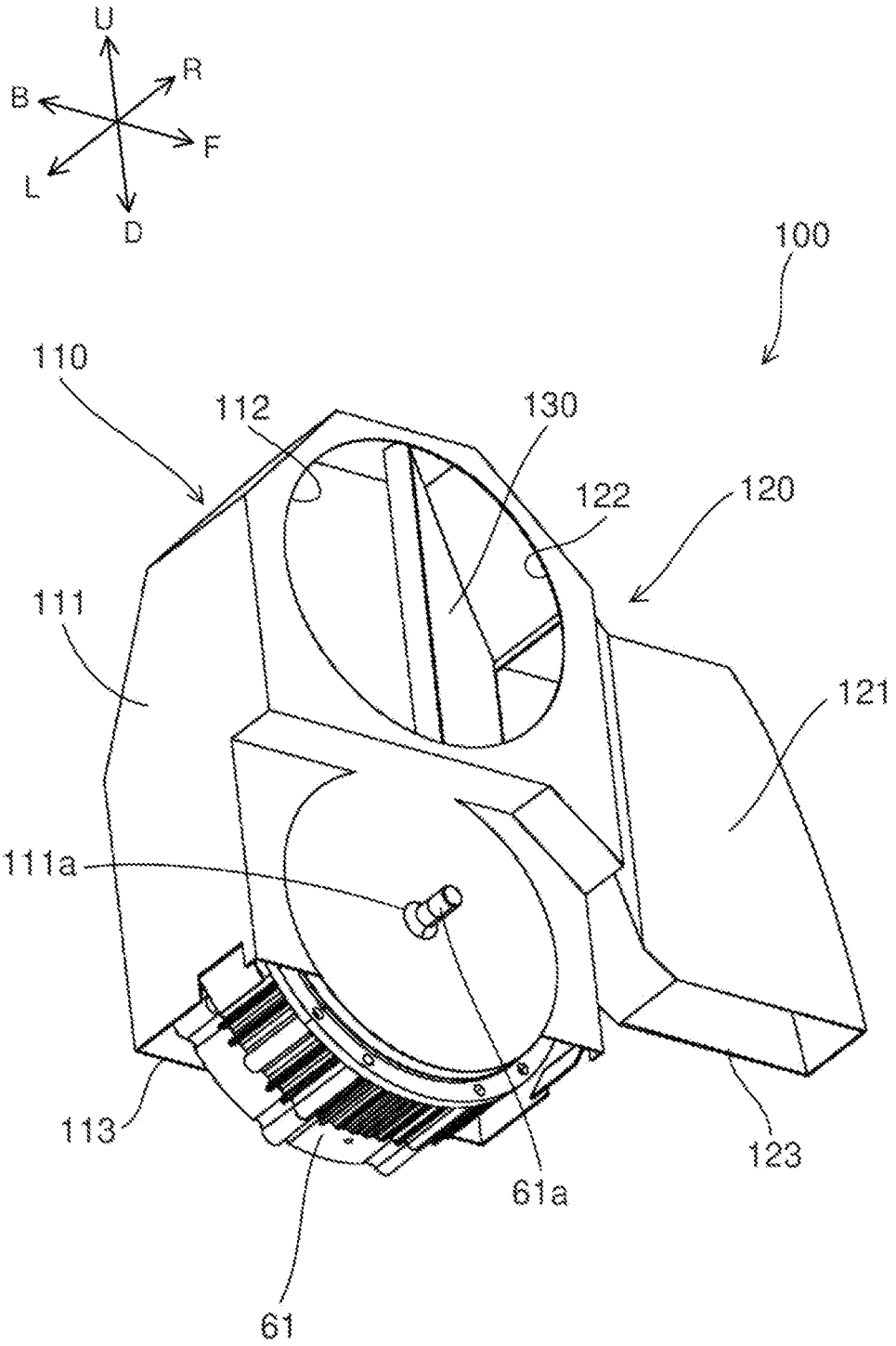
FIG. 11 is a perspective view of the wind guide when seen from below, with the electric motor accommodated therein.

At least a portion of the electric motor 61 (see FIG. 7) described above is disposed inside the first flow path 110. FIG. 11 is a perspective view of the wind guide 100 when seen from below, with the electric motor 61 accommodated in the first flow path 110. In the present embodiment, the electric motor 61 is disposed at and crossing the first flow path other-end-side opening 113 of the first flow path 110. Thus, part of the electric motor 61 is disposed inside the first flow path 110. Alternatively, the entirety of the electric motor 61 may be positioned inside the first flow path 110. An output shaft 61*a* of the electric motor 61 passes through a through hole 111*a* formed in the first flow path body 111, and is connected with an input shaft of the hydraulic pump 71 (see FIG. 5, for example).

With reference to FIGS. 5 to 11, the flow of the wind (cooling wind) generated by driving the fan 91, and the effect to be obtained with the structure of the present embodiment are described.

By the rotation of the fan 91 around the rotation shaft CA (see FIG. 5), air is suctioned from outside the hydraulic excavator 1 into the engine room 44. As used herein, the drive type of the fan 91 into which air is suctioned from the outside is also referred to a "suction type". The air suctioned into the interior of the engine room 44 flows in the casing 90 from the right side to the left side.

Specifically, part of the wind suctioned from the outside by the fan 91 flows across the radiator 92 in the casing 90. In other words, a portion of the wind flows in the casing 90 through gaps in the radiator 92 or flows along the surface of the radiator 92 to go beyond the radiator 92. Thus, the radiator 92 is cooled. In other words, the refrigerant flowing through the radiator 92 is cooled by heat exchange.

The remainder of the wind suctioned by the fan 91 flows across the oil cooler 93 in the casing 90. That is, the remainder of the wind flows in the casing 90 through the gaps of the oil cooler 93 or flows along the surface of the oil cooler 93 to go beyond the oil cooler 93. Thus, the oil cooler 93 is cooled. In other words, the hydraulic oil flowing through the oil cooler 93 is cooled by heat exchange.

The wind after cooling the radiator 92 (after licking the radiator 92) and the wind after cooling the oil cooler 93 (after licking the oil cooler 93) flow toward the first and second flow paths 110 and 120.

As illustrated in FIG. 8, the first flow path 110 has the first flow path one-end-side opening 112 at one end thereof, opening toward the radiator 92 (see FIG. 6). This allows the wind after cooling the radiator 92 to enter the interior of the first flow path 110 (first flow path body 111) through the first flow path one-end-side opening 112. The wind having flowed through the interior of the first flow path 110 is then discharged downward through the first flow path other-end-side opening 113. Arrow W1 in FIG. 8 indicates the direction (path) in which the wind after cooling the radiator 92 flows in the first flow path 110.

On the other hand, the second flow path 120 has the second flow path one-end-side opening 122 at the other end thereof, opening toward the oil cooler 93. This allows the wind after cooling the oil cooler 93 to enter the interior of the second flow path 120 (second flow path body part 121) through the second flow path one-end-side opening 122. The wind having flowed through the interior of the second flow path 120 is then discharged downward through the second flow path other-end-side opening 123. Arrow W2 in FIG. 8 indicates the direction (path) of wind after cooling the oil cooler 93 in the second flow path 120.

A high temperature (for example, about 90° C.) hydraulic oil having been used to drive the hydraulic actuator 73 (see FIG. 2) is circulated back to the oil cooler 93. In contrast, the cooling water flowing through the radiator 92 is about 40° C., for example, and is cooler than the hydraulic oil flowing through the oil cooler 93. Thus, the wind after cooling the radiator 92 is relatively cooler than the wind after cooling the oil cooler 93. This means that the wind flowing through the first flow path 110 (wind after cooling the radiator 92) is relatively cold, and the wind flowing through the second flow path 120 (wind after cooling the oil cooler 93) is relatively hot.

Thus, by attaching the electric components EQ, such as the inverter 63 and the DC-DC converter 66, at the first flow path 110 as illustrated in FIGS. 3 and 4, and by placing the electric motor 61 at the first flow path other-end-side opening 113 as illustrated in FIG. 11, a relatively low temperature wind flowing through the first flow path 110 can be used to cool (air-cool) the heat-generating components such as the electric components EQ and the electric motor 61. Furthermore, the relatively high temperature wind flowing through the second flow path 120 can be discharged as it is (without being applied to the heat-generating components) to the outside through the second flow path other-end-side opening 123.

In the structure of the present embodiment described above, the radiator 92 and the oil cooler 93 are cooled simultaneously by driving a single fan 91. This implements a more compact layout compared to conventional structures with the plurality of fans 91.

The first flow path one-end-side opening 112 of the first flow path 110 is located in the flow path of the wind crossing the radiator 92 generated by driving the fan 91 (see arrow W1 in FIG. 8). In the above example, the first flow path one-end-side opening 112 is located at the flow path on the downstream side of the radiator 92. The second flow path one-end-side opening 122 of the second flow path 120 is located at the flow path of the wind crossing the oil cooler 93 generated by driving the fan 91 (see arrow W2 in FIG. 8). In the above example, the second flow path one-end-side opening 122 is located at the flow path on the downstream side of the oil cooler 93.

This enables effective use of the wind used for cooling either the radiator 92 or the oil cooler 93. In the above example, the relatively low temperature wind after cooling the radiator 92 can be effectively used to cool the heat-generating components.

From the viewpoint of reliably separating and discharging the relatively high temperature wind after cooling the oil cooler 93 from the relatively low temperature wind after cooling the radiator 92, it is desirable that the first flow path other-end-side opening 113 of the first flow path 110 and the second flow path other-end-side opening 123 of the second flow path 120 be located apart from each other, as illustrated in FIG. 9.

In particular, from the viewpoint of easily implementing a layout in which the relatively high temperature air after cooling the oil cooler 93 is discharged outside the machine through the second flow path other-end-side opening 123 without directing the wind to the electric motor 61 that requires air-cooling, it is desirable that the second flow path other-end-side opening 123 of the second flow path 120 be located in front of the electric motor 61, as illustrated in FIG. 11. In this case, the relatively high temperature wind passing through the second flow path other-end-side opening 123 may be discharged forward to the outside of the machine from below the floor of the driver seat 41*a* (see FIG. 1), or may be discharged downward through an opening (not illustrated) in the turn frame 42.

The position of the second flow path other-end-side opening 123 relative to the electric motor 61 is not particularly limited (not limited to "in front of the electric motor 61" as mentioned above), but the above layout that allows direct discharging of the relatively high temperature wind after cooling the oil cooler 93 outside the machine needs to be implemented. For example, the second flow path other-end-side opening 123 may be located behind the electric motor 61.

Figure 12:
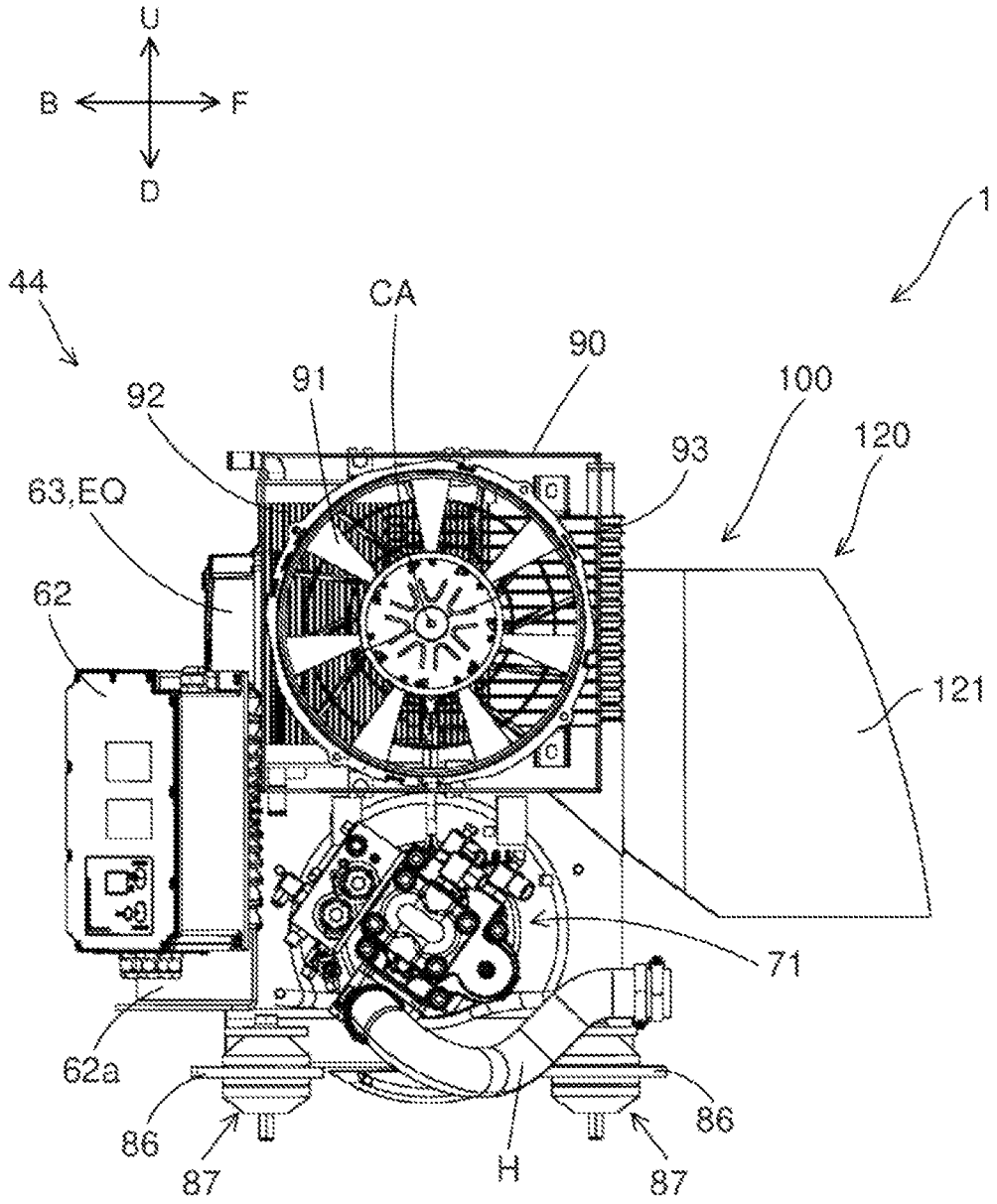
FIG. 12 is a side view of the portion A in FIG. 4 when seen from the right.

FIG. 12 is a side view of the portion A of FIG. 4 when seen from the right, that is, in the direction of the rotation shaft CA of the fan 91. From the viewpoint of directing the wind to both the radiator 92 and the oil cooler 93 by driving a single fan 91 and facilitating to implement a compact layout preferable for a small hydraulic excavator 1, it is desirable that the radiator 92 and the oil cooler 93 be located inside the casing 90 as described below. In other words, it is desirable that the radiator 92 and the oil cooler 93 be located overlapping with the fan 91 from the direction of the rotation shaft CA of the fan 91 as illustrated in FIG. 12, and displaced from each other in a direction (for example, the front-back direction) intersecting the rotation shaft CA, as illustrated in FIG. 6. The radiator 92 and the oil cooler 93 may be displaced in the up-down direction, but this example will be described later (see FIG. 18).

Figure 13:
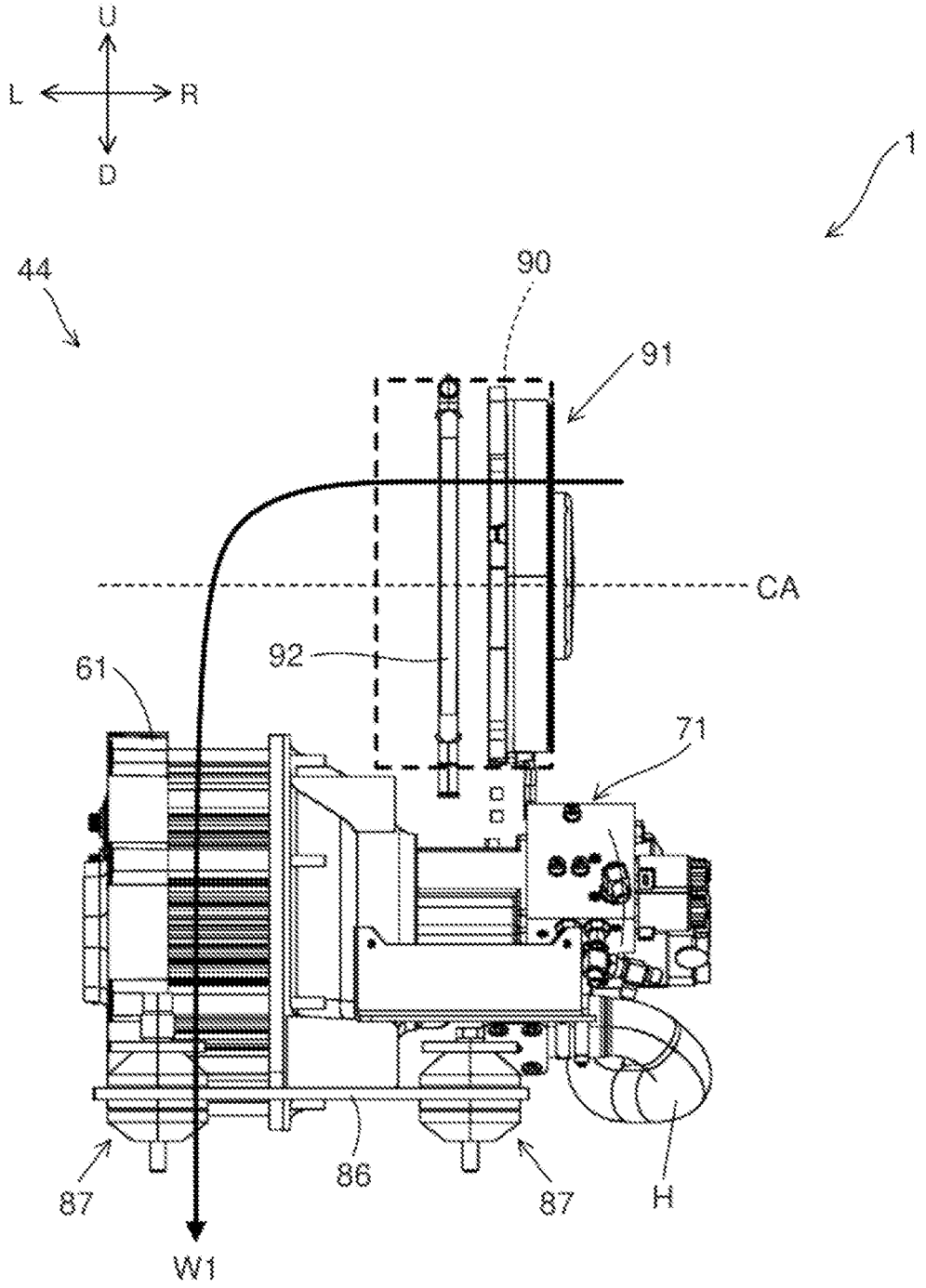
FIG. 13 is a side view of the portion A in FIG. 4 when seen from the back.

FIG. 13 is a side view of the portion A of FIG. 4 when seen from the back. For convenience, the wind guide 100 and oil cooler 93 described above are omitted from FIG. 13. From the viewpoint of effectively use the space (narrow space) above the electric motor 61 in the engine room 44 as the cooling flow path of the electric motor 61 by providing the flow path of the wind (flow path in the interior of the first flow path 110), which is generated by driving the fan 91 and cooling the electric motor 61, in the up-down direction (vertical direction), it is desirable that at least a portion of the fan 91 be located above the electric motor 61. In the present embodiment, the positional relationship between the fan 91 and the electric motor 61 in the up-down direction is defined so that the rotation shaft CA of the fan 91 is located above the electric motor 61. This ensures the vertical cooling flow path (the space for disposing the first flow path 110) above the electric motor 61.

The electric motor 61 is supported on a bottom plate 86 connecting to the hydraulic pump 71 in the extending direction (the left-right direction in FIG. 13) of the output shaft 61*a* (see FIG. 11). The bottom plate 86 is supported on the turn frame 42 (see FIG. 3, for example) via a vibration-proof member 87. This allows the electric motor 61 and hydraulic pump 71 to be supported on the turn frame 42 in a vibration-proof manner.

In the suction type, from the viewpoint of ensuring effective use of the relatively low temperature wind after cooling the radiator 92 for cooling (air-cooling) the electric motor 61, it is desirable that at least a portion of the electric motor 61 be located inside the first flow path 110, as illustrated in FIG. 11. From the viewpoint of promptly discharging the wind after cooling the electric motor 61, it is desirable that the electric motor 61 be located at the first flow path other-end-side opening 113. The electric motor 61 may be located below the first flow path other-end-side opening 113.

In the suction type, from the viewpoint of effectively using the relatively low temperature wind flowing through the first flow path 110 after cooling the radiator 92 for cooling (air-cooling) the electric components EQ illustrated in FIG. 3 or the like, it is desirable that the electric components EQ be located at the first flow path 110. In other words, it is desirable that the hydraulic excavator 1 include the electric components EQ located at the first flow path 110. Here, the electric components EQ include the inverter 63 and the DC-DC converter 66, as described above.

Figure 14:
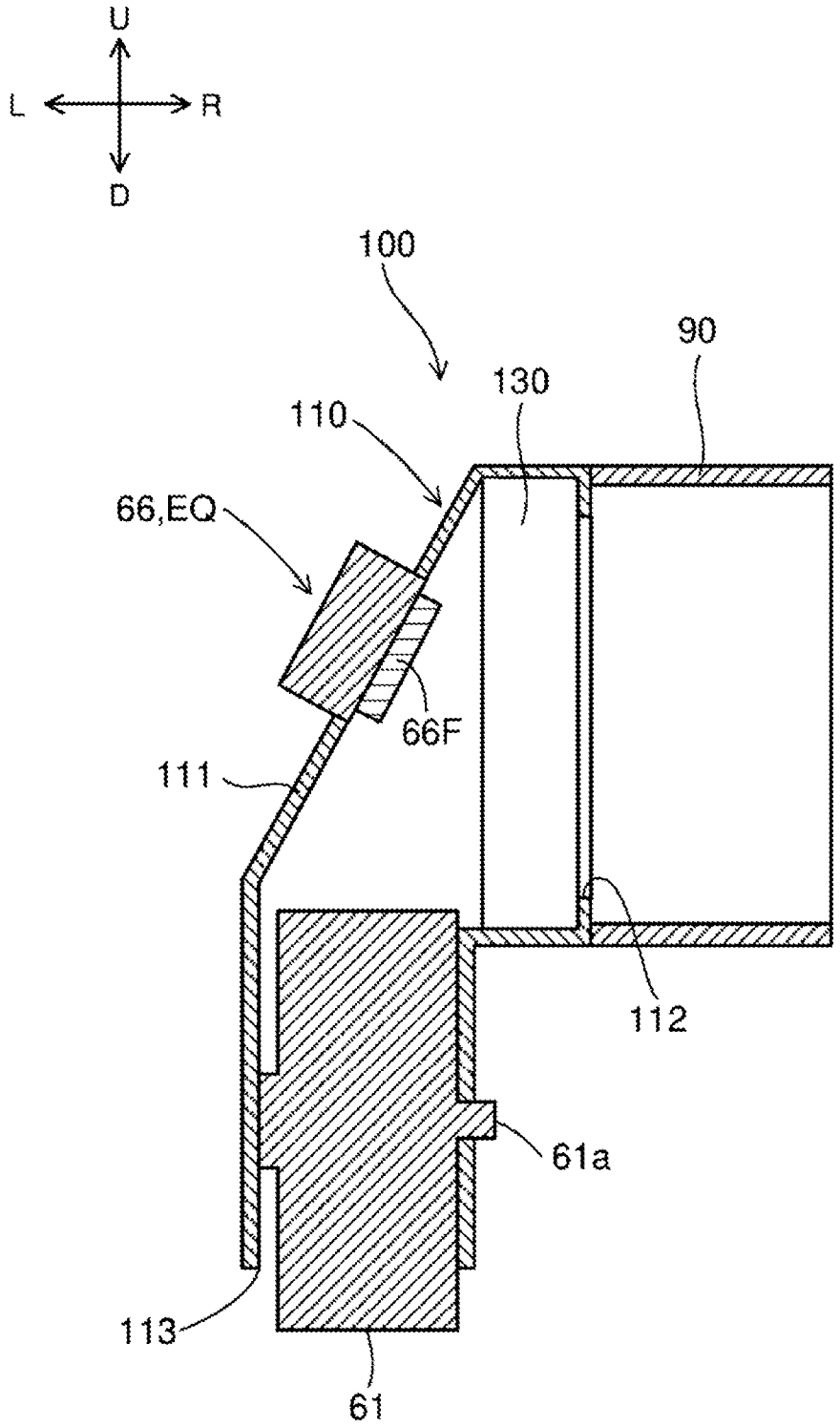
FIG. 14 is a cross-sectional view of the first flow path of the wind guide when cut along a section through an electric component.

FIG. 14 is a cross-sectional view of the first flow path 110 when cut along a section through the electric component EQ. In FIG. 14, the DC-DC converter 66 is illustrated as an example of the electric component EQ. The DC-DC converter 66 as the electric component EQ includes a heat sink 66F. The heat sink 66F is composed of fins, for example. As illustrated in this drawing, from the viewpoint of increasing the cooling efficiency of the electric component EQ by directing the low temperature wind to the heat sink 66F, it is desirable that the heat sink 66F be located inside the first flow path 110. In other words, it is desirable that the electric component EQ be attached to (embedded in) the first flow path 110 so that the heat sink 66F is located inside the first flow path 110.

The structure in which the heat sink is disposed inside the first flow path 110 is also applicable to the inverter 63 provided as the electric component EQ. In other words, from the viewpoint of increasing the cooling efficiency, when the inverter 63 includes the heat sink, it is desirable to attach (embed) the inverter 63 to (in) the first flow path 110 so that the heat sink is located inside the first flow path 110.

As described above, the fan 91 generates, upon rotation, the wind that passes through the radiator 92 (first heat exchanger) into the interior of the first flow path 110 through the first flow path one-end-side opening 112, while generating the wind that passes through the oil cooler 93 (second heat exchanger) into the second flow path 120 through the second flow path one-end-side opening 122. By driving the fan 91 in this way, the suction type structure is implemented in which the outside air is suctioned to cool the radiator 92 and the oil cooler 93, while the relatively low temperature wind is effectively used (to cool the heat-generating components) after cooling the radiator 92.

Figure 15:
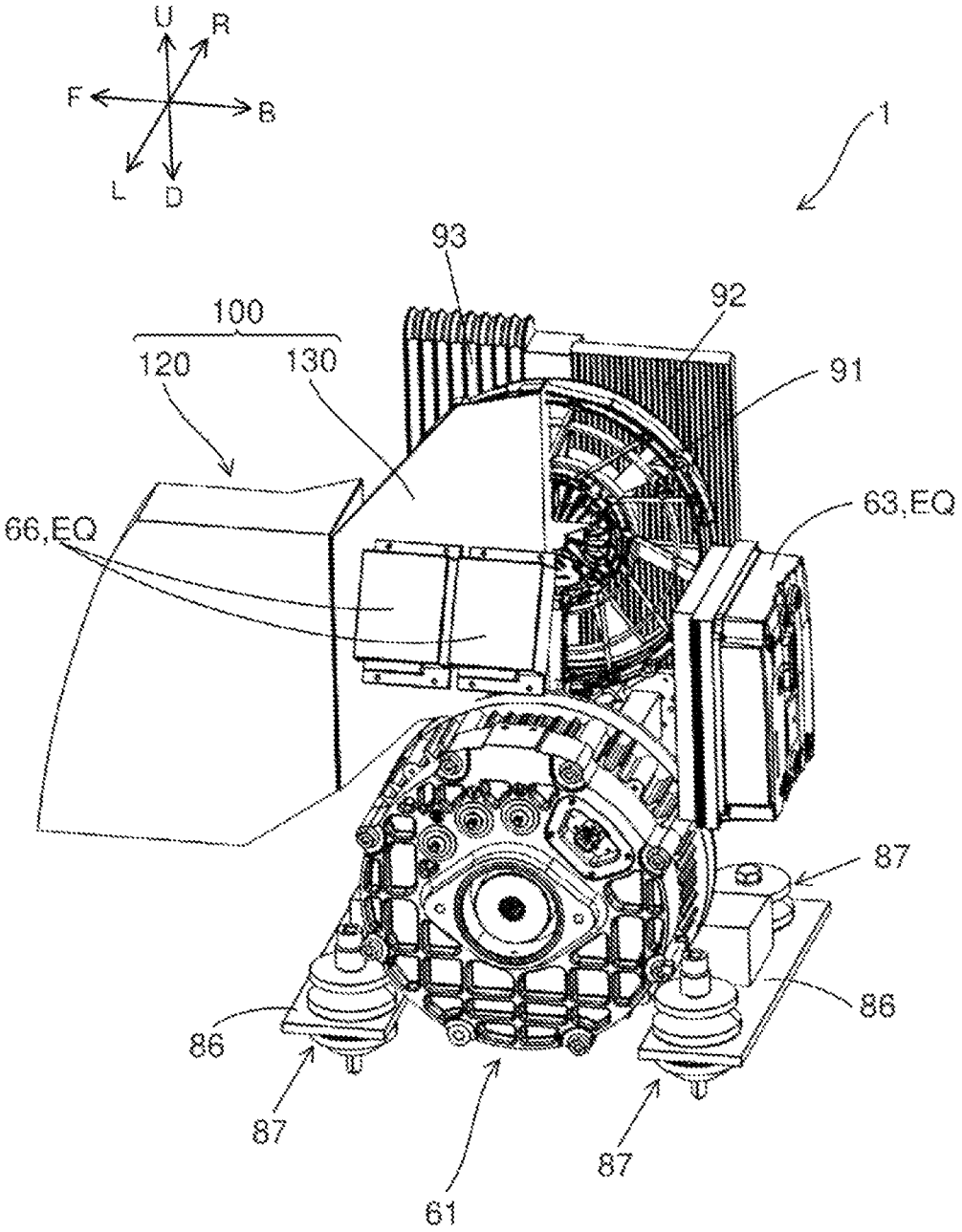
FIG. 15 is a partially cutaway perspective view of the structure of a modification of the hydraulic excavator.

FIG. 15 is a partially cutaway perspective view of the structure of a modification of the suction type. As illustrated in this drawing, the fan 91 may be located on the side of the wind guide 100, that is, on the side of the battery unit 53 (see FIG. 3), relative to the radiator 92 and the oil cooler 93. Even with this arrangement of fan 91, the relatively low temperature wind used to cool the radiator 92 can be effectively used (for cooling heat-generating components) in the suction type.

However, in this structure, the wind generated by driving the fan 91 by suctioning air from the outside flows across the fan 91 toward the first and second flow paths 110 and 120 after cooling the radiator 92 and the oil cooler 93. Because the fan 91 is rotating, the wind after cooling the radiator 92 and the wind after cooling the oil cooler 93 may be mixed (in front of the wind guide 100) after crossing the fan 91. When the relatively low temperature wind after cooling the radiator 92 is mixed with the relatively high temperature wind after cooling the oil cooler 93, and the mixed wind is led to, for example, the first flow path 110, the cooling effect of the electric components EQ and the electric motor 61 using the relatively low temperature wind may be reduced. From the viewpoint of avoiding such reduction in the cooling effectiveness, it is desirable that the fan 91 be located on the side opposite to the wind guide 100 (opposite to the battery unit 53) with respect to the radiator 92 and the oil cooler 93, as illustrated in, for example, FIG. 5.

4. ANOTHER STRUCTURE OF INSIDE OF ENGINE ROOM

Figure 16:
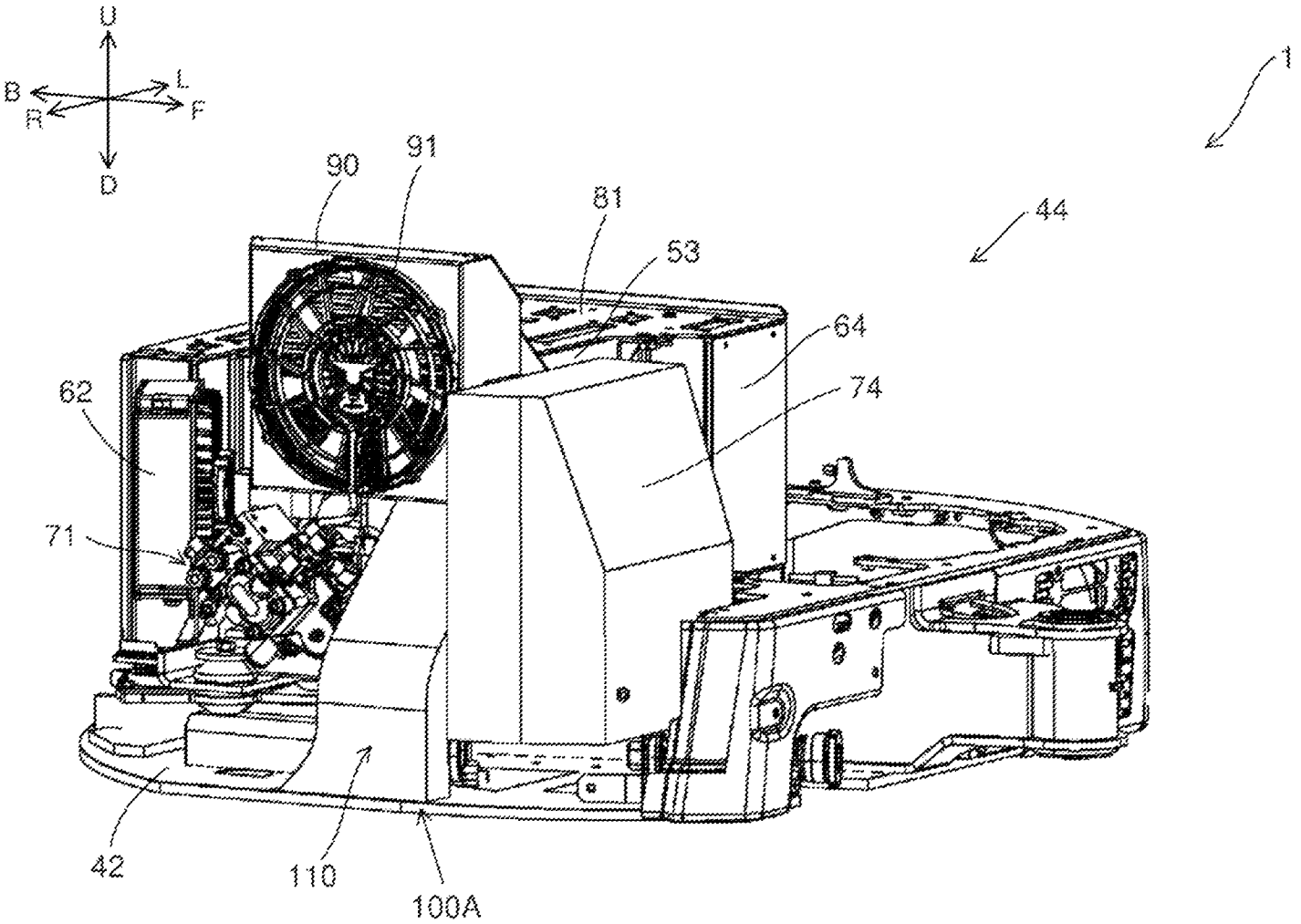
FIG. 16 is a perspective view of another structure of the inside of the engine room of the hydraulic excavator.
Figure 17:
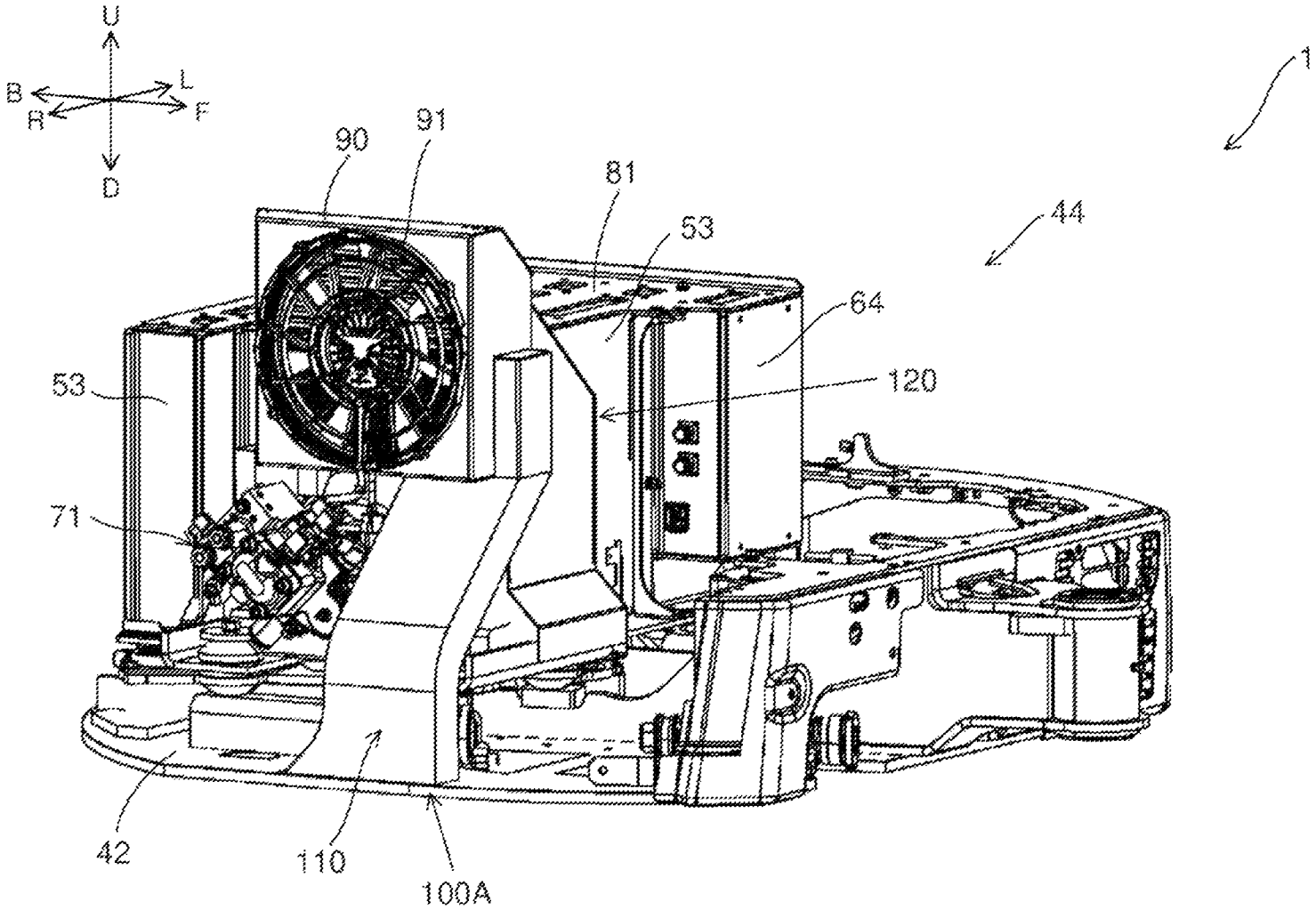
FIG. 17 is a perspective view of the structure illustrated in FIG. 16 with a hydraulic oil tank and a charger omitted therefrom.
Figure 18:
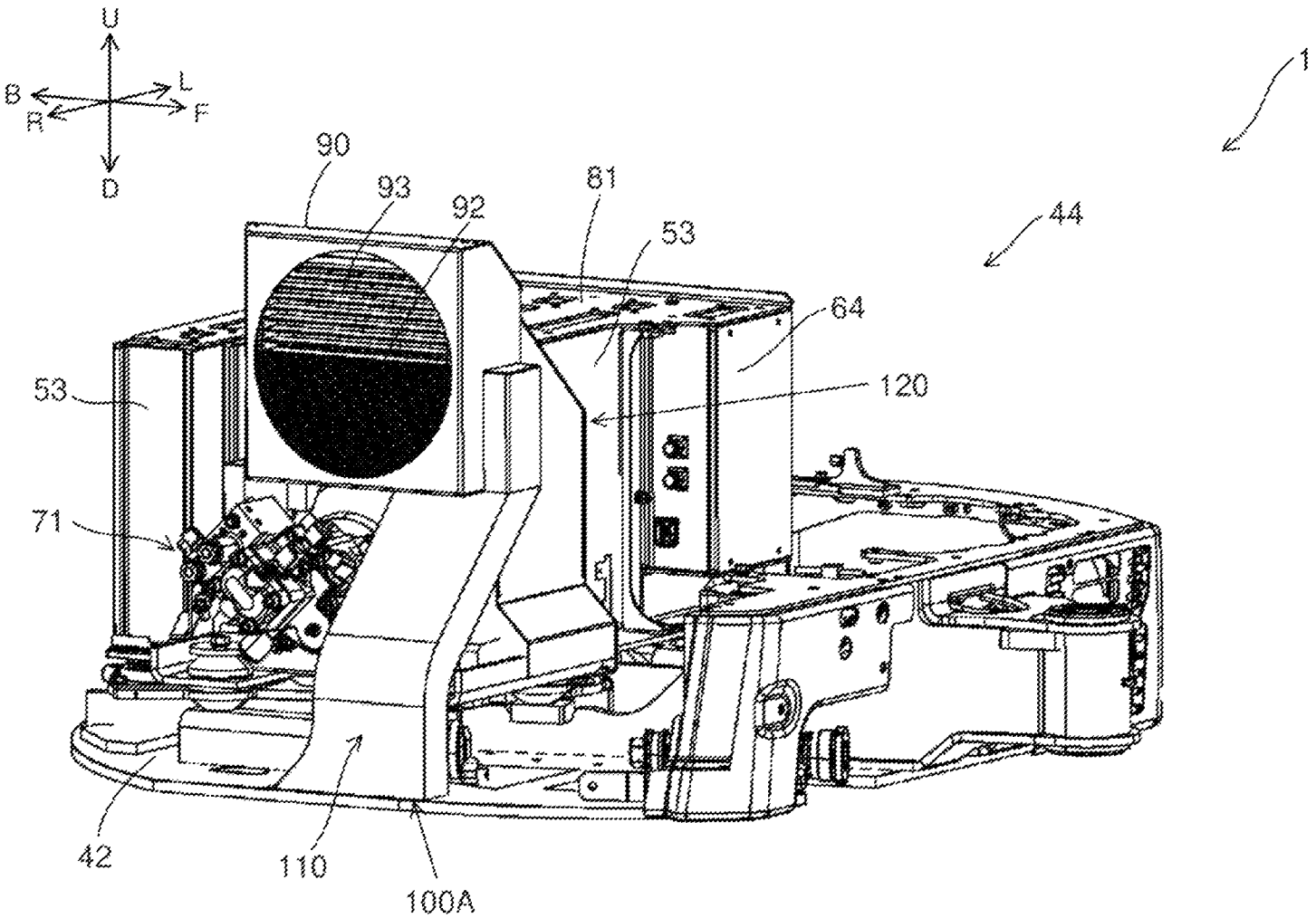
FIG. 18 is a perspective view of the structure illustrated in FIG. 17 with the fan omitted therefrom.
Figure 19:
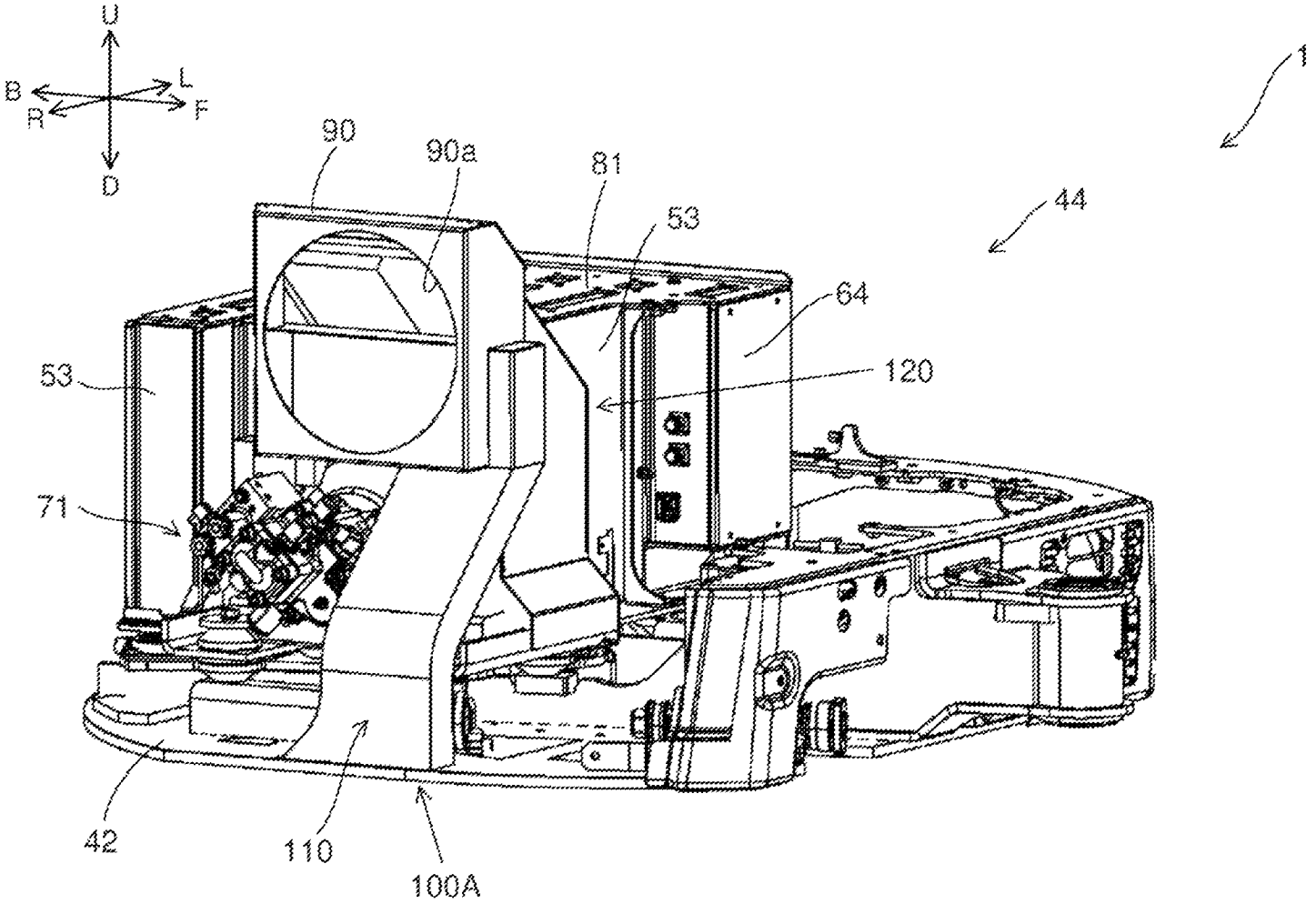
FIG. 19 is a perspective view of the structure illustrated in FIG. 18 with the radiator and the oil cooler omitted therefrom.

FIG. 16 is a perspective view of another structure of the inside of the engine room 44 of the hydraulic excavator 1. FIG. 17 is a perspective view of the structure illustrated in FIG. 16 with the hydraulic oil tank 74 and the charger 62 omitted therefrom. FIG. 18 is a perspective view of the structure illustrated in FIG. 17 with the fan 91 omitted therefrom. FIG. 19 is a perspective view of the structure illustrated in FIG. 18 with the radiator 92 and the oil cooler 93 omitted therefrom.

The structure illustrated in FIG. 16 and subsequent drawings is a "discharging type" structure. The term "discharge type" refers to a driving type of the fan 91 in which the air inside the engine room 44 of the hydraulic excavator 1 is discharged to the outside by the rotation of the fan 91. In the discharge type, a wind guide 100A is used instead of the wind guide 100 (see FIG. 8, for example) used in the suction type. In other words, in the discharge type, the air in the wind guide 100A in the engine room 44 flows through the casing 90 and is discharged to the outside of the hydraulic excavator 1.

Also, in the discharge type, the arrangement of the radiator 92 and the oil cooler 93 in the casing 90 is different from that of the suction type for the purpose of facilitating the layout of the wind guide 100A in the engine room 44. Specifically, as illustrated in FIG. 18, the radiator 92 and the oil cooler 93 are arranged in a row in the up-down direction in the casing 90. The oil cooler 93 is located above the radiator 92. Alternatively, the radiator 92 and the oil cooler 93 may be arranged as in the suction type. In other words, the radiator 92 and the oil cooler 93 may be disposed in the front-back direction. The fan 91 is located to the right of the radiator 92 and the oil cooler 93, that is, on the side opposite to the wind guide 100A, but may be located on the side of the wind guide 100A.

Figure 20:
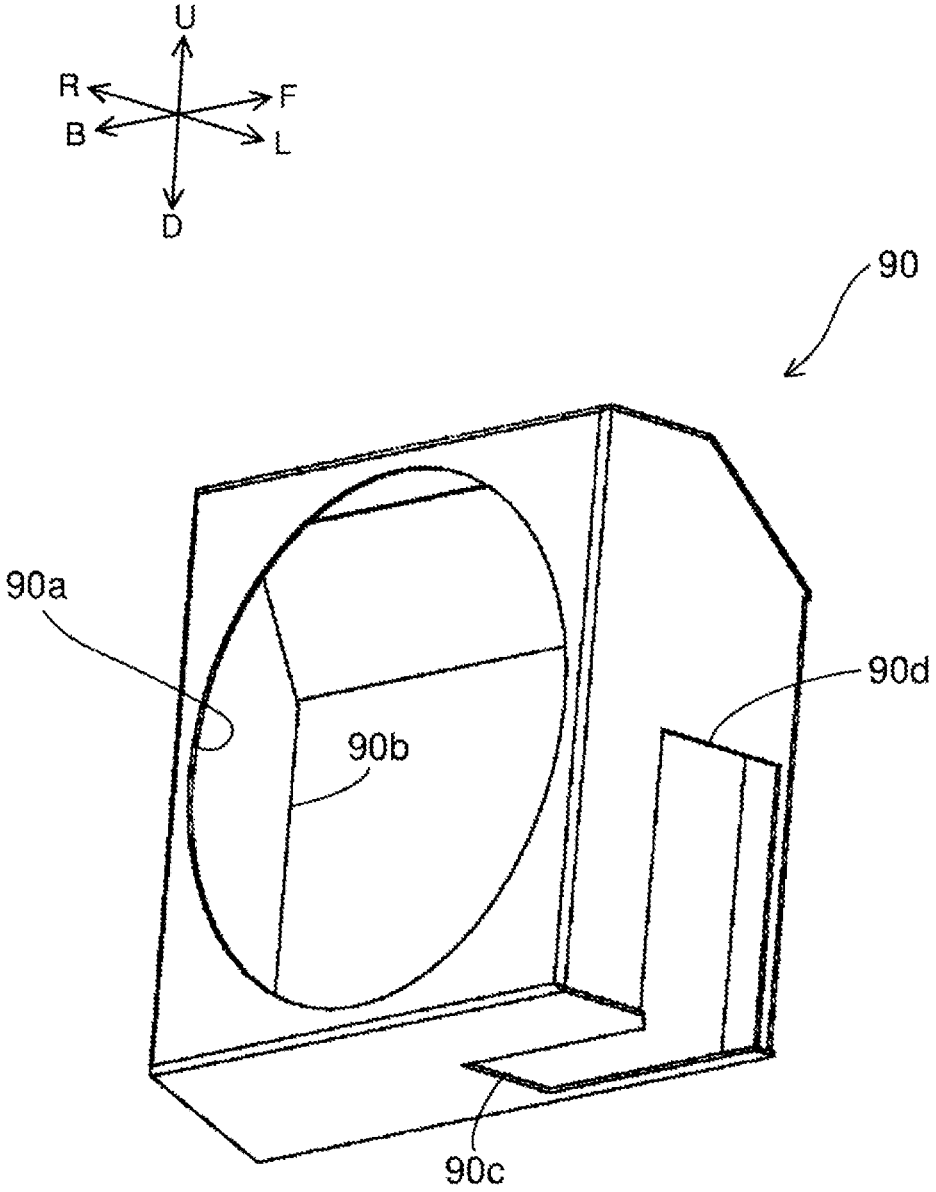
FIG. 20 is a perspective view of a casing suitable for another structure of the wind guide when seen from below.
Figure 21:
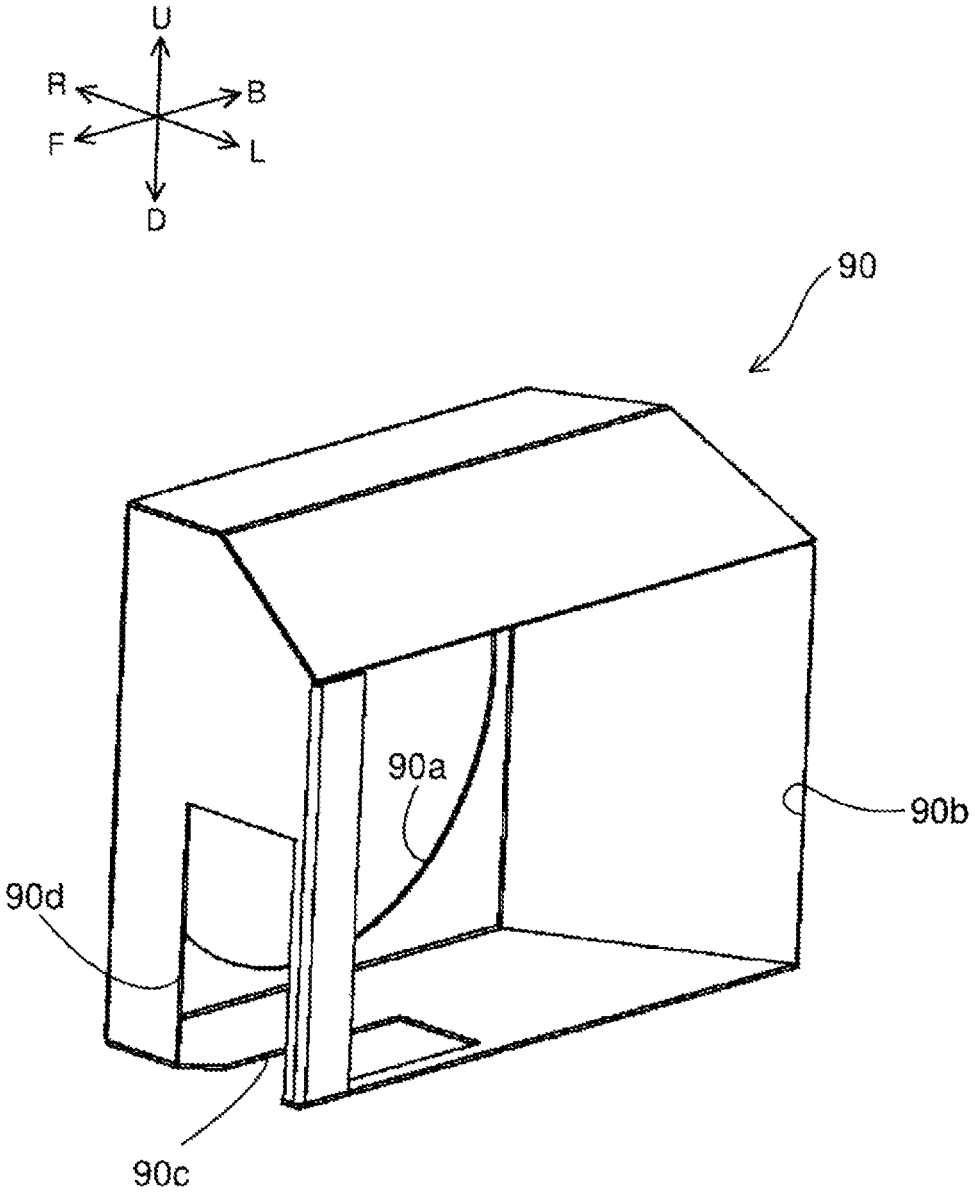
FIG. 21 is a perspective view of the casing when seen from above.

In the discharge type, the structure of the casing 90 connected to the wind guide 100A is also slightly different from that of the suction type along with the application of the wind guide 100A. FIG. 20 is a perspective view of the casing 90 suitable for the wind guide 100A when seen from the lower right side. FIG. 21 is a perspective view of the casing 90 when seen from the upper left side.

The casing 90 is a frame with a first opening 90*a* on the right side and a second opening 90*b* on the left side. The first opening 90*a* is circular and the second opening 90*b* is rectangular, but these shapes are not limited. The left half of the top surface of the casing 90 slopes downward.

The casing 90 further has a first notch 90*c* and a second notch 90*d*. The first notch 90*c* is an opening formed by partially cutting out the bottom surface of the casing 90. The second notch 90*d* is an opening formed by partially cutting out the front surface of the casing 90. The first notch 90*c* communicates with the second notch 90*d*. This creates a partial opening from the bottom surface to the front surface of the casing 90.

The wind guide 100A used in the discharge type is described in detail below. For convenience of explanation, the same reference signs will be given to the constituent components having the same functions as those of the wind guide 100 used in the suction type.

Figure 22:
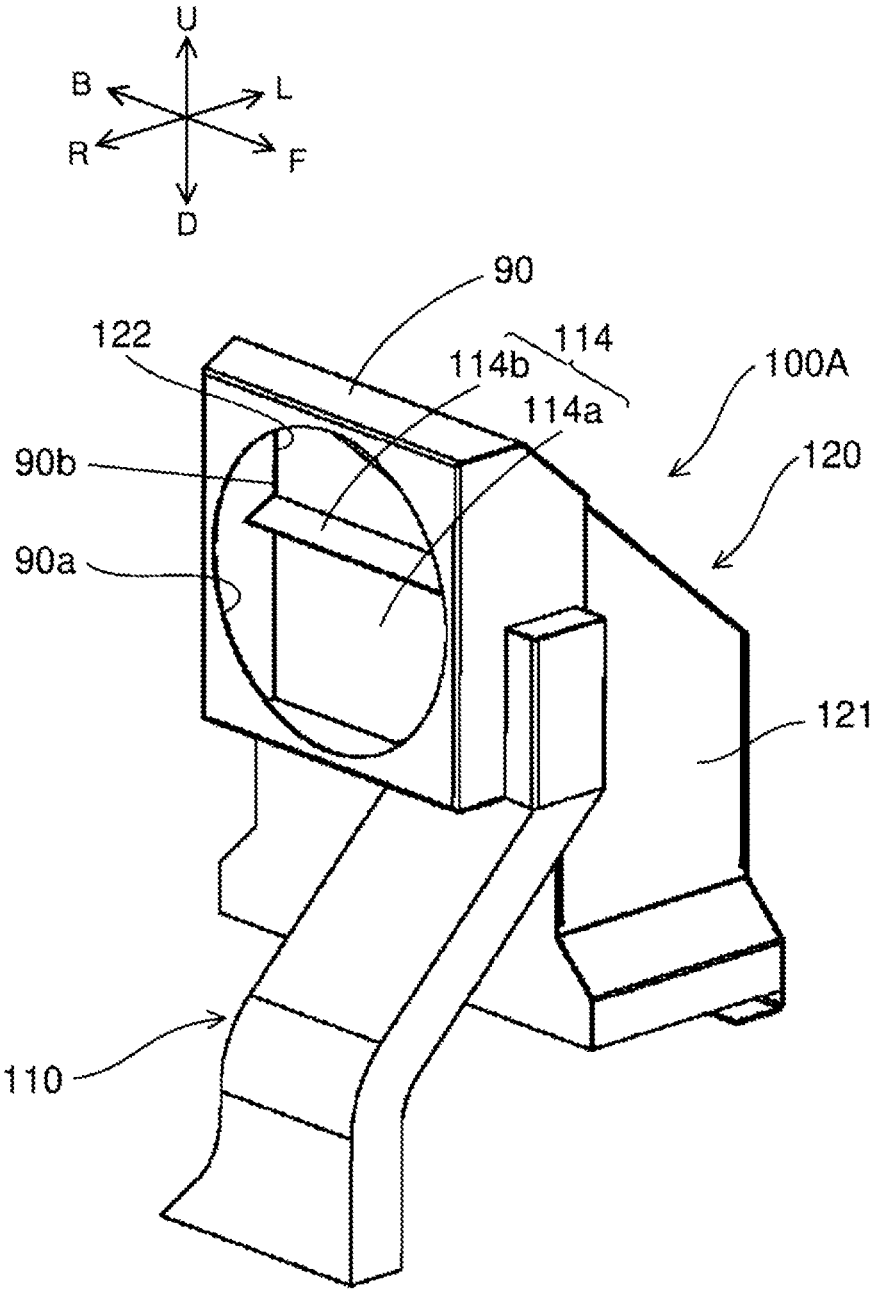
FIG. 22 is a perspective view of the casing and the wind guide when seen from above.
Figure 23:
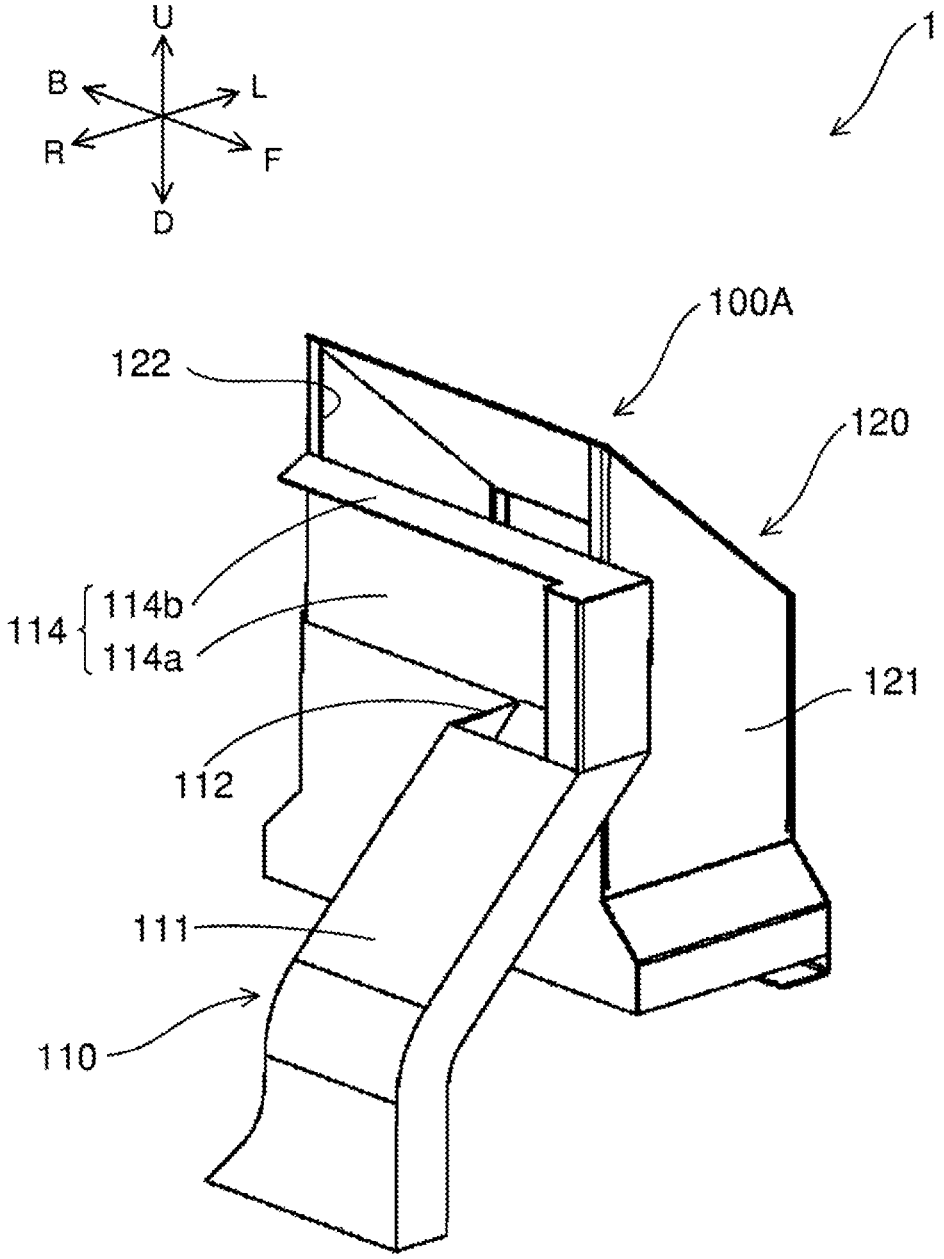
FIG. 23 is a perspective view of the wind guide illustrated in FIG. 22 when seen from above, with the casing omitted therefrom.
Figure 24:
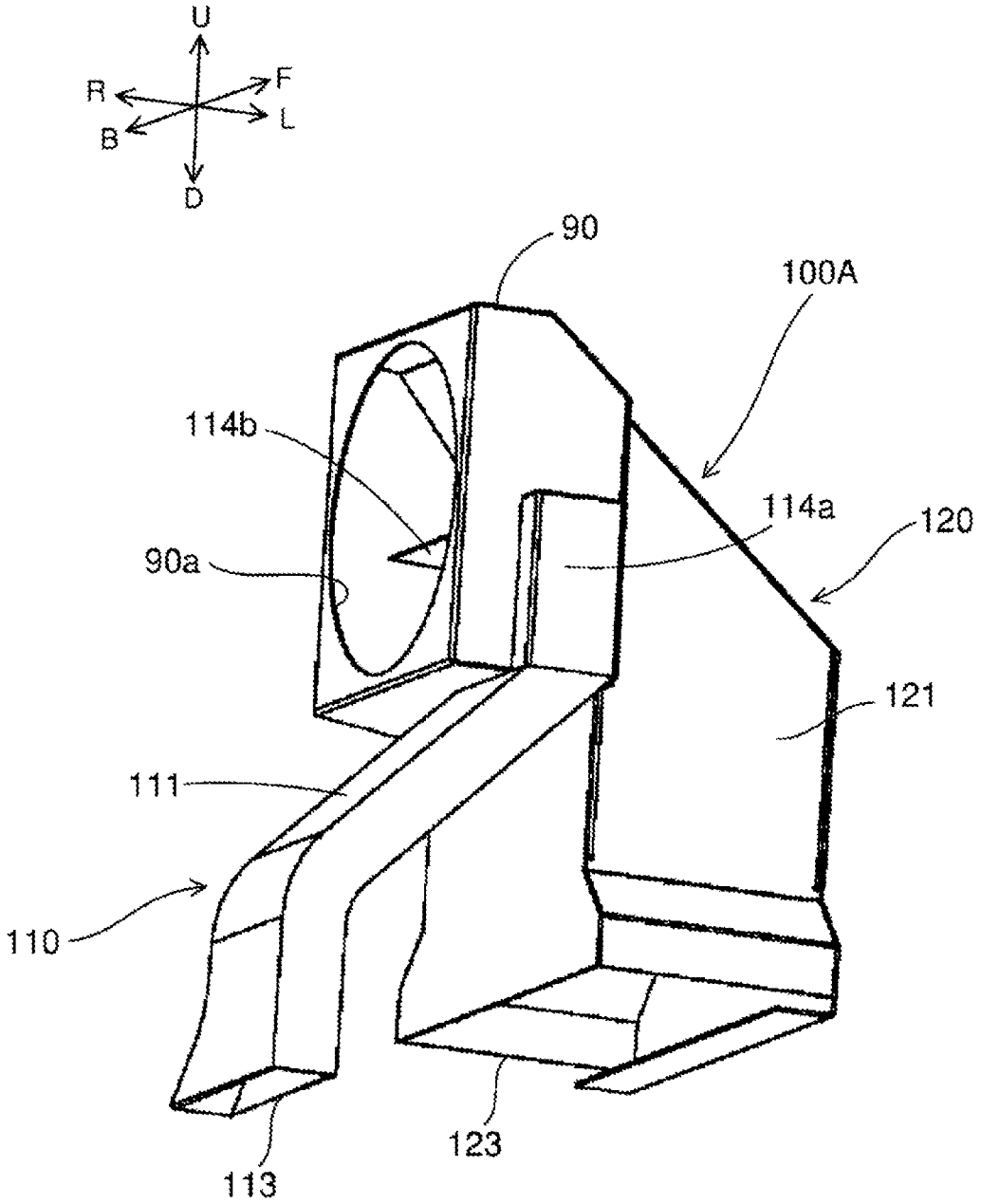
FIG. 24 is a perspective view of the casing and the wind guide when seen from below.
Figure 25:
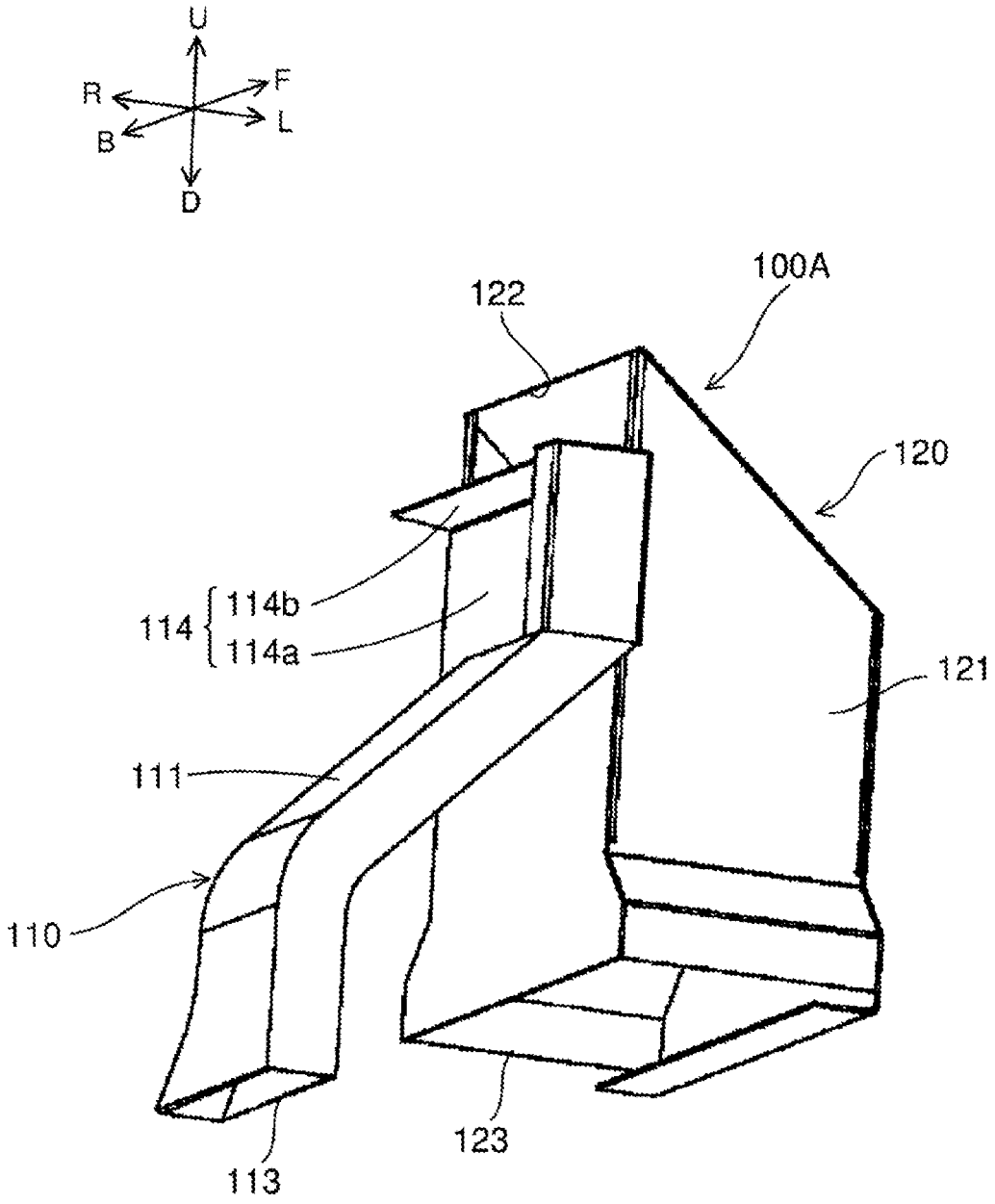
FIG. 25 is a perspective view of the wind guide illustrated in FIG. 24 when seen from below, with the casing omitted therefrom.

FIG. 22 is a perspective view of the casing 90 and the wind guide 100A when seen from above. FIG. 23 is a perspective view of the wind guide 100A illustrated in FIG. 22 when seen from above, with the casing 90 omitted therefrom. FIG. 24 is a perspective view of the casing 90 and the wind guide 100A when seen from below. FIG. 25 is a perspective view of the wind guide 100A of FIG. 24 when seen from below, with the casing 90 omitted therefrom.

The wind guide 100A includes the first flow path 110 and the second flow path 120. The first flow path 110 is located to the right of the second flow path 120. The first flow path 110 has the first flow path body 111, the first flow path one-end-side opening 112, the first flow path other-end-side opening 113, and a cover member 114.

The first flow path body 111 is shaped to extend from below to the left diagonally upward and is hollow inside. Part of the wind generated by driving the fan 91 passes through the interior of the first flow path body 111. The first flow path one-end-side opening 112 is located at the upper end of the first flow path body 111. The first flow path other-end-side opening 113 is located at the lower end of the first flow path body 111. That is, the first flow path 110 has the first flow path one-end-side opening 112 at one end and the first flow path other-end-side opening 113 at the other end.

The cover member 114 is located above the first flow path body 111 and is connected to the first flow path body 111. The cover member 114 has a connecting portion 114*a* extending upward from below and an upper plate 114*b* connected to the upper end of the connecting portion 114*a*. The height position of the upper plate 114*b* roughly coincides with the position of the boundary between the radiator 92 and the oil cooler 93 in the casing 90.

A portion of the lower edge of the connecting portion 114*a* is connected to a portion of the outer edge of the first flow path one-end-side opening 112 of the first flow path body 111, that is, the front right edge, the front edge, and the left edge of the first flow path one-end-opening 112 (see FIG. 23).

The cover member 114 is located across the second notch 90*d* (see FIGS. 20 and 21) of the casing 90. Thus, the cover member 114 is partially located inside the casing 90 (see FIGS. 22 and 24). The upper plate 114*b* of the cover member 114 divides the space on the left side of the casing 90 into upper and lower sections.

Figure 26:
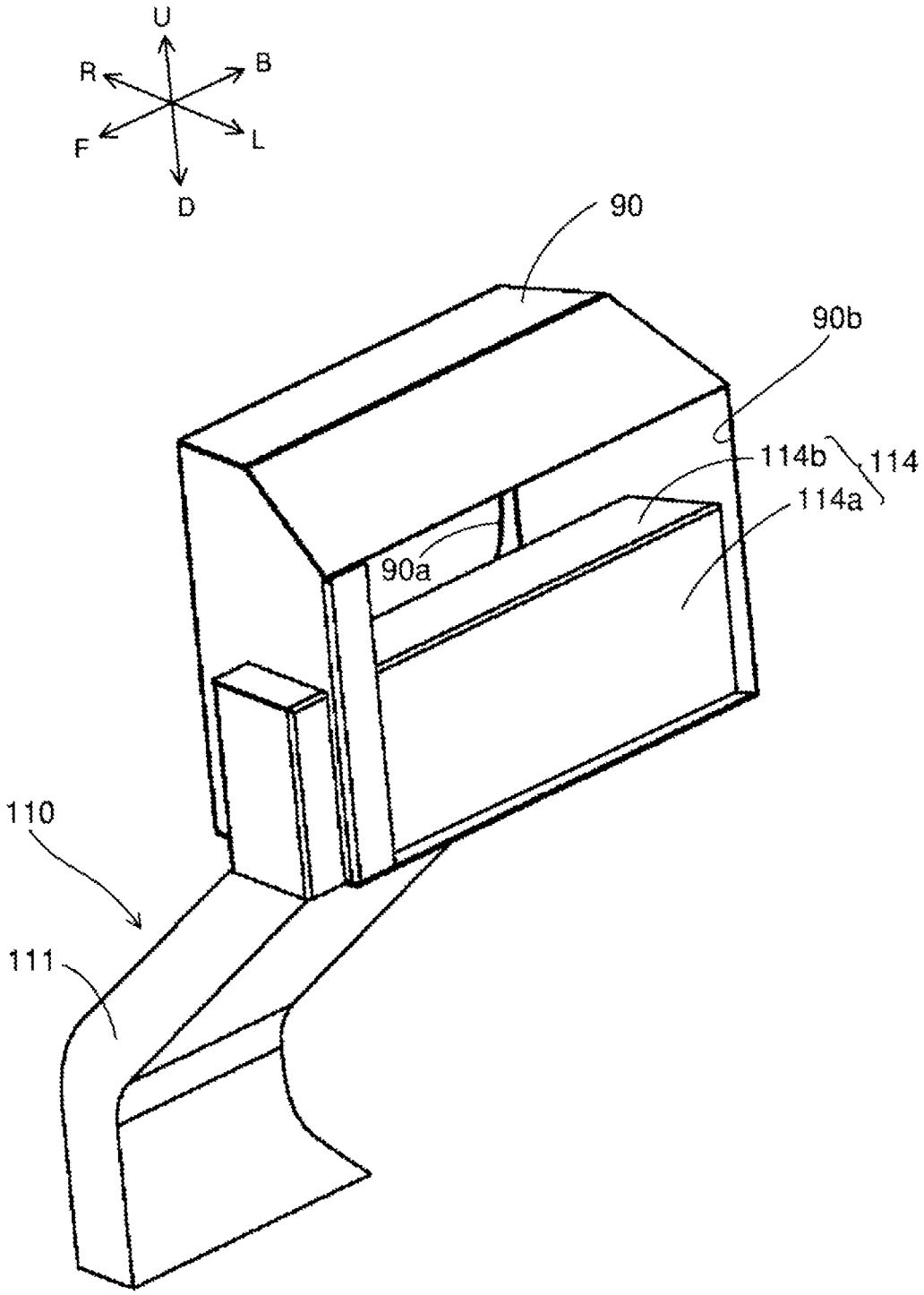
FIG. 26 is a perspective view of the casing and a cover member of the wind guide when seen from above.

FIG. 26 is a perspective view of the casing 90 and the cover member 114 when seen from the upper left. As illustrated in this drawing, the connecting portion 114*a* of the cover member 114 substantially closes an area wider than the lower half of the second opening 90*b* of the casing 90.

The second flow path 120 has the second flow path body 121, the second flow path one-end-side opening 122, and the second flow path other-end-side opening 123. The second flow path body 121 is formed extending in the up-down direction and is hollow inside. The second flow path one-end-side opening 122 opens toward the casing 90 side, that is, to the right near the upper end of the second flow path body 121 (see FIGS. 22 and 23). The second flow path other-end-side opening 123 is located at the lower end of the second flow path body 121 and opens downward (see FIGS. 24 and 25). In other words, the second flow path 120 has the second flow path one-end-side opening 122 at one end and the second flow path other-end-side opening 123 at the other end.

The connecting portion 114*a* of the cover member 114 described above is affixed to the right side of the second flow path body 121 (see FIGS. 23 and 25). As a result, the second flow path one-end-side opening 122 is located above the cover member 114.

The second flow path other-end-side opening 123 is located to the left of the first flow path other-end-side opening 113. In other words, the first flow path other-end-side opening 113 and the second flow path other-end-side opening 123 are located apart.

Figure 27:
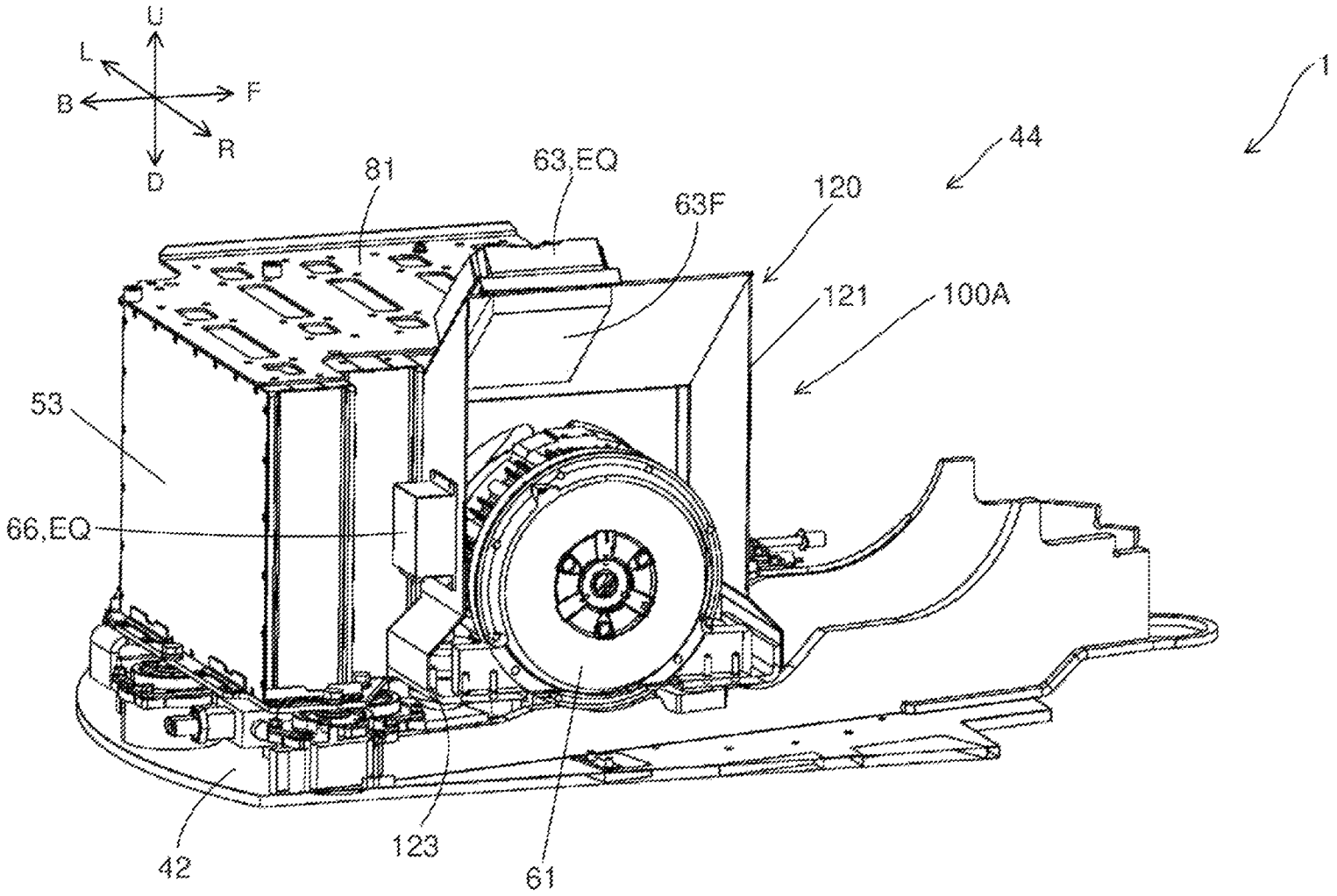
FIG. 27 is a perspective view of the inside of the engine room of the hydraulic excavator when cut along a section through a second flow path of the wind guide.

FIG. 27 is a perspective view of the inside of the engine room 44 of the hydraulic excavator 1 when cut along a section through the second flow path 120 of the wind guide 100A. In the discharge type, unlike the suction type, at least a portion of the electric motor 61 is located inside the second flow path 120. In addition, the electric components EQ are also provided at the second flow path 120. Here, the electric components EQ include the inverter 63 and the DC-DC converter 66.

Figure 28:
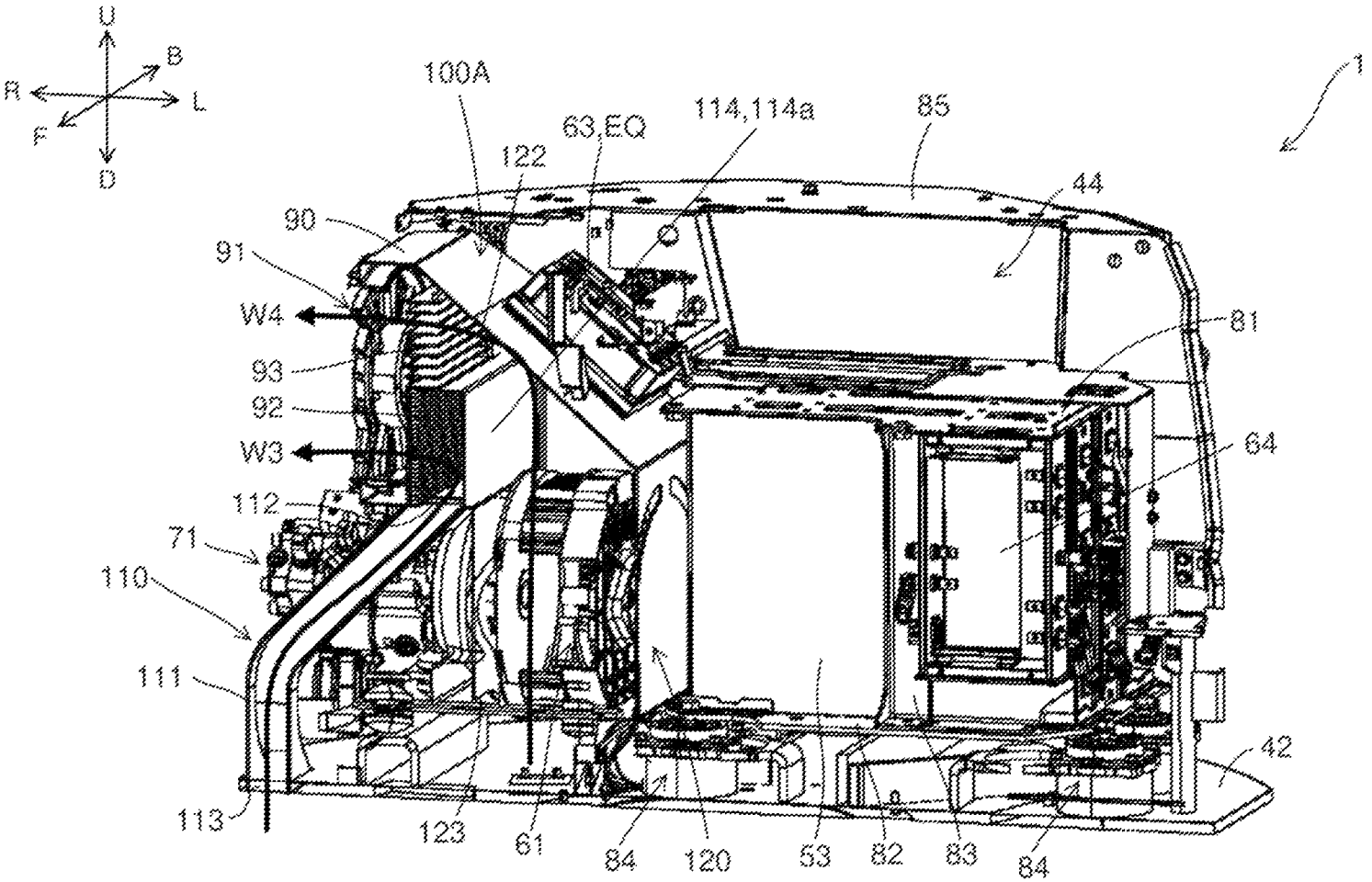
FIG. 28 is a perspective view of the inside of the engine room of the hydraulic excavator when cut along another section through the first and second flow paths of the wind guide.

FIG. 28 is a perspective view of the interior of the engine room 44 of the hydraulic excavator 1 when cut along another section through the first and second flow paths 110 and 120 of the wind guide 100A. The wind (cooling wind) generated by the driving of the fan 91 and its effects are described below with reference to FIGS. 16 to 28.

In the suction type, when the fan 91 is rotated in the direction opposite to the direction of rotation of the fan 91, the air inside the engine room 44 is discharged to the outside of the hydraulic excavator 1.

More specifically, the rotation of the fan 91 suctions air into the first flow path 110 through the first flow path other-end-side opening 113, while suctioning air into the second flow path 120 through the second flow path other-end-side opening 123.

The air suctioned into the first flow path 110 flows upward through the interior of the first flow path body 111 and is introduced into the casing 90 through the first flow path one-end-side opening 112. Inside the casing 90, the air travels along the connecting portion 114*a* and the upper plate 114*b* of the cover member 114 and heads toward the radiator 92 side. In other words, the cover member 114 bends the direction of the air flow from the upper direction to the right direction.

The wind, which becomes the air heading toward the radiator 92 in the casing 90, flows across the radiator 92. In other words, the wind flows through the gaps in the radiator 92 in the casing 90 or along the surface of the radiators 92 to go beyond the radiators 92. Thus, the radiator 92 is cooled. In other words, the refrigerant flowing through the radiator 92 is cooled by heat exchange. After cooling the radiator 92, the wind (wind that has licked the radiator 92) is discharged across the fan 91 to the outside of the engine room 44. Arrow W3 in FIG. 28 indicates the path of the wind that cools the radiator 92 in the discharge type.

On the other hand, air suctioned into the second flow path 120 through the second flow path other-end-side opening 123 flows upward inside the second flow path body 121 and is introduced into the casing 90 through the second flow path one-end-side opening 122. Inside the casing 90, the air travels along the upper plate 114*b* of the cover member 114 toward the oil cooler 93.

The wind, which becomes the air heading toward the oil cooler 93 in the casing 90, flows across the oil cooler 93. In other words, the above wind flows through the gaps in the oil cooler 93 in the casing 90 or along the surface of the oil coolers 93 to go beyond the oil coolers 93. Thus, the oil cooler 93 is cooled. In other words, the hydraulic oil flowing through the oil cooler 93 is cooled by heat exchange. After cooling the oil cooler 93, the wind (wind that has licked the oil cooler 93) is discharged across the fan 91 to the outside of the engine room 44. Arrow W4 in FIG. 28 indicates the path of the wind that cools the oil cooler 93 in the discharge type.

Therefore, as illustrated in FIG. 27, by arranging the heat-generating components such as the electric motor 61 and the electric components EQ at the second flow path 120, the wind flowing through the second flow path 120 can be applied to the heat-generating components to cool (air-cool) them. Since the oil cooler 93 originally has the high temperature hydraulic oil flowing through it, it is very much possible to cool the oil cooler 93 by directing the wind whose temperature is increased by air cooling of the heat-generating components to the oil cooler 93. On the other hand, the radiator 92 can be efficiently cooled by directing the wind whose temperature is lower than that of the wind flowing through the second flow path 120 through the first flow path 110, thus effectively cooling the radiator 92.

As in the suction type, the discharge type is configured, as described above, that the first flow path one-end-side opening 112 of the first flow path 110 is located at the wind flow path of the wind generated by driving the fan 91 and crossing the radiator 92, and the second flow path one-end-side opening 122 is located at the wind flow path of the wind generated by driving the fan 91 and crossing the oil cooler 93.

Therefore, with the discharge type, one of the winds used to cool the radiator 92 and the oil cooler 93 can be effectively used to cool the electric motor 61 and other heat-generating components. In the above example, the wind used to cool the oil cooler 93 (wind flowing through the second flow path 120) can be effectively used to cool the heat-generating components. Similar to the suction type, a compact layout can be implemented by cooling the radiator 92 and the oil cooler 93 with a single fan 91 as in the suction type.

As described above, from the viewpoint of effectively using the wind used for cooling the oil cooler 93 to cool the electric motor 61, it is desirable that at least a portion of the electric motor 61 be located inside the second flow path 120.

In particular, from the viewpoint of ensuring that the wind taken into the interior of the second flow path 120 through the second flow path other-end-side opening 123 is directed to the electric motor 61 to reliably cool the electric motor 61, it is desirable that at least a portion of the electric motor 61 be located above the second flow channel other-end-side opening 123 of the second flow path 120.

As illustrated in FIGS. 16 to 19, in terms of effective use of the limited space inside the engine room 44, it is desirable that the first flow path 110 of the wind guide 100A be located alongside the hydraulic pump 71. In particular, it is desirable that the first flow path 110 be located in front of the hydraulic pump 71.

From the viewpoint of forming the first flow path 110 in the layout extending in the up-down direction and implementing the compact layout, it is desirable that the first flow path other-end-side opening 113 of the first flow path 110 be formed at the turn frame 42 (machine frame) located below the electric motor 61, as illustrated in FIG. 28.

From the viewpoint of effectively using the wind used to cool the oil cooler 93 for cooling the electric component EQ, it is desirable that the electric component EQ be located at the second flow path 120, as illustrated in FIG. 27. In other words, the hydraulic excavator 1 is desirably includes the electric components EQ disposed at the second flow path 120.

In the structure where the electric component EQ has a heat sink, it is desirable that the heat sink be located inside the second flow path 120. In the example of FIG. 27, the inverter 63 as the electric component EQ has a heat sink 63F. The heat sink 63F is composed of fins, for example. The inverter 63 is attached to (embedded in) the second flow path 120 so that the heat sink 63F is located inside the second flow path 120.

As described above, the fan 91 is rotated to generate the wind passing through the first flow path 110 and toward the radiator 92 (first heat exchanger) through the first flow path one-end-side opening 112, and generate the wind through the second flow path 120 and toward the oil cooler 93 (second heat exchanger) through the second flow path one-end-side opening 122. The driving of the fan 91 implements the discharge type structure in which the wind used to cool the oil cooler 93 (as well as the heat-generating components) can be effectively used.

The wind guide 100A also includes the cover member 114 illustrated in FIG. 28, for example. The cover member 114 is a deflection member that is located in the wind path across the radiator 92 by driving the fan 91 and changes the direction of wind by reflecting the wind. The cover member 114 is located in the flow path between the radiator 92 and the first flow path one-end-side opening 112 to bend the flow path. The use of such a cover member 114 allows the direction of the wind flowing upward through the interior of the first flow path 110 by driving the fan 91 to the right, that is, across the radiator 92, and direct the wind onto the radiator 92. Thus, the radiator 92 can be cooled in a compact structure.

5. SUPPLEMENTAL DESCRIPTION

The hydraulic excavator 1 which is the construction machine has been described heretofore as the example of the electric work machine, but the electric work machine is not limited to the hydraulic excavator 1 and may be any other construction machine such as a wheel loader. The electric work machine may be an agricultural machine such as a combine harvester, a tractor or the like.

6. APPENDIX

The hydraulic excavator 1 described in the present embodiment can also be referred to as an electric work machine as illustrated in the following appendices.

An electric work machine of appendix (1) includes an electric motor, an electric instrument connected to the electric motor via a power supply path, a first heat exchanger that cools a refrigerant passing through the electric instrument, a hydraulic pump driven by the electric motor and discharging a working oil, a second heat exchanger that cools the working oil, a fan, and a first flow path and a second flow path, in which the first flow path has a first flow path one-end-side opening at one end thereof, the second flow path has a second flow path one-end-side opening at one end thereof, the first flow path one-end-side opening is located at a flow path of wind generated by driving the fan and crossing the first heat exchanger, and the second flow path one-end-side opening is located at a flow path of wind generated by driving the fan and crossing the second heat exchanger.

The electric work machine of appendix (2) is the electric work machine of appendix (1) in which the first flow path has a first flow path other-end-side opening at the other end thereof, the second flow path has a second flow path other-end-side opening at the other end thereof, and the first flow path other-end-side opening is located apart from the second flow path other-end-side opening.

The electric work machine of appendix (3) is the electric work machine of appendix (1) or (2) in which the first heat exchanger and the second heat exchanger are located overlapping with the fan when seen in a direction of a rotation shaft of the fan, and are displaced from each other in a direction intersecting the rotation shaft.

The electric work machine of appendix (4) is the electric work machine of any one of appendices (1) to (3) in which at least a portion of the fan is located above the electric motor.

The electric work machine of appendix (5) is the electric work machine of any one of appendices (1) to (4) in which the electric instrument includes a battery unit that stores power to drive the electric motor.

The electric work machine of appendix (6) is the electric work machine of any one of appendices (1) to (5) in which at least a portion of the electric motor is located inside the first flow path.

The electric work machine of appendix (7) is the electric work machine of appendix (2) in which the electric motor is located at the first flow path other-end-side opening of the first flow path.

The electric work machine of appendix (8) is the electric work machine of any one of appendices (1) to (7) further including an electric component disposed at the first flow path.

The electric work machine of appendix (9) is the electric work machine of appendix (8) in which the electric component includes a heat sink, and the heat sink is located inside the first flow path.

The electric work machine of appendix (10) is the electric work machine of appendix (2) in which the second flow path other-end-side opening of the second flow path is located in front of the electric motor.

The electric work machine of appendix (11) is the electric work machine of any one of appendices (1) to (10), in which the fan is rotated to generate wind flowing from the first heat exchanger into the interior of the first flow path through the first flow path one-end-side opening, and generate wind flowing from the second heat exchanger into the interior of the second flow path through the second flow path one-end-side opening.

The electric work machine of appendix (12) is the electric work machine of any one of appendices (1) to (11) in which the first flow path one-end-side opening opens toward the first heat exchanger, and the second flow path one-end-side opening opens toward the second heat exchanger.

The electric work machine of appendix (13) is the electric work machine of any one of appendices (1) to (5) in which at least a portion of the electric motor is located inside the second flow path.

The electric work machine of appendix (14) is the electric work machine of appendix (2) in which at least a portion of the electric motor is located above the second flow path other-end-side opening of the second flow path.

The electric work machine of appendix (15) is the electric work machine of any one of appendices (1) to (5), (13), and (14) in which the first flow path is located alongside the hydraulic pump.

The electric work machine of appendix (16) is the electric work machine of appendix (2) or (13), further including a machine body frame located below the electric motor, in which the first flow path other-end-side opening of the first flow path is formed in the machine body frame.

The electric work machine of appendix (17) is the electric work machine of any one of appendices (1) to (5) and (13) to (16), further including an electric component disposed at the second flow path.

The electric work machine of appendix (18) is the electric work machine of appendix (17) in which the electric component has a heat sink, and the heat sink is located inside the second flow path.

The electric work machine of appendix (19) is the electric work machine of any one of appendices (1) to (5) and (13) to (18) in which the fan is rotated to generate wind flowing through the first flow path and toward the first heat exchanger through the first flow path one-end-side opening, and generate wind flowing through the second flow path and toward the second heat exchanger through the second flow path one-end-side opening.

The electric work machine of appendix (20) is the electric work machine of any one of appendices (1) to (5) and (13) to (19), further including a deflection member located in a flow path of wind generated by driving the fan and crossing the first heat exchanger, in which the deflection member is located in the flow path between the first heat exchanger and the first flow path one-end-side opening and bends the flow path.

Although the embodiment of the present invention has been described above, the scope of the invention is not limited thereto, and can be expanded or modified without deviating from the gist of the present invention.

INDUSTRIAL APPLICABILITY

The present invention is applicable to work machines such as a construction machine, an agricultural machine, and the like.

REFERENCE SIGNS LIST

1 Hydraulic excavator (electric work machine)
42 Turn frame (machine body frame)
53 Battery unit (electric instrument)
61 Electric motor
63 Inverter (electric component)

63F Heat sink
66 DC-DC converter (electric component)
66F Heat sink
71 Hydraulic pump
91 Fan
92 Radiator (first heat exchanger)
93 Oil cooler (second heat exchanger)
110 First flow path
112 First flow path one-end-side opening
113 First flow path other-end-side opening
114 Cover member (deflection member)
120 Second flow path
122 Second flow path one-end-side opening
123 Second flow path other-end-side opening
CA Rotation shaft
EL Electric instrument
EQ Electric component
PA Power Supply Path

The invention claimed is:

1. An electric work machine comprising:
an electric motor;
an electric instrument connected to the electric motor via a power supply path;
a first heat exchanger configured to cool a refrigerant passing through the electric instrument;
a hydraulic pump configured to be driven by the electric motor and discharge a working oil;
a second heat exchanger configured to cool the working oil;
a fan;
a first flow path;
a second flow path; and
an engine room configured to accommodate at least the electric motor and the hydraulic pump,
wherein the first flow path has a first flow path one-end-side opening at one end thereof,
wherein the second flow path has a second flow path one-end-side opening at one end thereof,
wherein the first flow path one-end-side opening is located at a flow path of wind generated by driving the fan and that crosses the first heat exchanger,
wherein the second flow path one-end-side opening is located at a flow path of wind generated by driving the fan and that crosses the second heat exchanger; and
wherein a second flow path other-end-side opening of the second flow path is formed in a machine body frame, and the first flow path having the first flow path other-end-side opening at the other end thereof, the first flow path other-end-side opening provided in the engine room.

2. The electric work machine according to claim 1, wherein the second flow path has a second flow path other-end-side opening at the other end thereof,
the first flow path other-end-side opening is located apart from the second flow path other-end-side opening,
the first heat exchanger is disposed closer to the first flow path one-end-side opening than the first flow path other-end-side opening and the second heat exchanger, and
the second heat exchanger is disposed closer to the second flow path one-end-side opening than the second flow path other-end-side opening and the first heat exchanger.

3. The electric work machine according to claim 1, wherein the first heat exchanger and the second heat exchanger are located overlapping with the fan when seen in a direction of a rotation shaft of the fan, and displaced from each other in a direction intersecting the rotation shaft.

4. The electric work machine according to claim 1, wherein at least a portion of the fan is located above the electric motor.

5. The electric work machine according to claim 1, wherein the electric instrument includes a battery unit that is configured to store power to drive the electric motor.

6. The electric work machine according to claim 1, wherein at least a portion of the electric motor is located inside the first flow path.

7. The electric work machine according to claim 2, wherein the electric motor is located at the first flow path other-end-side opening of the first flow path.

8. The electric work machine according to claim 1, further comprising:
an electric component disposed at the first flow path.

9. The electric work machine according to claim 8, wherein:
the electric component includes a heat sink, and
the heat sink is located inside the first flow path.

10. The electric work machine according to claim 2, wherein the second flow path other-end-side opening of the second flow path is located in front of the electric motor.

11. The electric work machine according to claim 1, wherein the fan is configured to rotate to:
generate wind to flow from the first heat exchanger into an interior of the first flow path through the first flow path one-end-side opening, and
generate wind to flow from the second heat exchanger into an interior of the second flow path through the second flow path one-end-side opening.

12. The electric work machine according to claim 1, wherein:
the first flow path one-end-side opening is open toward the first heat exchanger, and
the second flow path one-end-side opening is open toward the second heat exchanger.

13. The electric work machine according to claim 1, wherein at least a portion of the electric motor is located inside the second flow path.

14. The electric work machine according to claim 2, wherein at least a portion of the electric motor is located above the second flow path other-end-side opening of the second flow path.

15. The electric work machine according to claim 1, wherein the first flow path is located alongside the hydraulic pump.

16. The electric work machine according to claim 2, further comprising:
the machine body frame located below the electric motor, and
a structure that defines the first flow path and the second flow path, the structure including:
an inlet, and
a divider that divides the inlet into the first flow path one-end-side opening and the second flow path one-end-side opening.

17. The electric work machine according to claim 1, further comprising:
an electric component located at the second flow path.

18. The electric work machine according to claim 17, wherein:
the electric component includes a heat sink, and
the heat sink is disposed inside the second flow path.

19. The electric work machine according to claim 1, wherein the fan is configured to rotate to:

generate wind to flow through the first flow path and toward the first heat exchanger through the first flow path one-end-side opening, and generate wind to flow through the second flow path and toward the second heat exchanger through the second flow path one-end-side opening.

20. The electric work machine according to claim 1, further comprising:

a deflection member located in a flow path of wind, driven by the fan, that crosses the first heat exchanger, and wherein the deflection member is located in the flow path between the first heat exchanger and the first flow path one-end-side opening and is configured to bend the flow path.

* * * * *